US006719390B1

(12) United States Patent
Howkins et al.

(10) Patent No.: US 6,719,390 B1
(45) Date of Patent: Apr. 13, 2004

(54) SHORT DELAY PHASED FIRING TO REDUCE CROSSTALK IN AN INKJET PRINTING DEVICE

(75) Inventors: Stuart D. Howkins, Ridgefield, CT (US); Charles A. Willus, Newtown, CT (US); Osamu Machida, Hitachinaka (JP)

(73) Assignee: Hitachi Printing Solutions America, Inc., Simi Valley, CA (US)

( * ) Notice: Subject to any disclaimer, the term of this patent is extended or adjusted under 35 U.S.C. 154(b) by 0 days.

(21) Appl. No.: 10/403,204

(22) Filed: Mar. 31, 2003

(51) Int. Cl.[7] ..... B41J 29/38; B41J 29/393
(52) U.S. Cl. ..... 347/12; 347/19
(58) Field of Search ..... 347/12, 11, 19, 347/5, 14, 10, 9, 40, 20, 48; 310/317; 358/296, 298

(56) References Cited

U.S. PATENT DOCUMENTS 6,296,340 B1 * 10/2001 Tajika et al. ..... 347/12
6,386,666 B1 * 5/2002 Takamura et al. ..... 347/12

* cited by examiner

*Primary Examiner*—Raquel Yvette Gordon
*Assistant Examiner*—Charles Stewart, Jr.
(74) *Attorney, Agent, or Firm*—Pillsbury Winthrop LLP

(57) ABSTRACT

An inkjet printing system includes an array of transducers to eject ink, the array including the transducers divided into interspersed sets. A controller controls a firing sequence of the array of transducers. One set of transducers is fired, and after a delay, another set of transducers is fired and then, after further delays, each set is fired in turn. The delays are selected based on known response characteristics of the array of transducers to minimize the average crosstalk for all of the sets.

35 Claims, 10 Drawing Sheets

SHORT DELAY PHASED FIRING TO REDUCE CROSSTALK IN AN INKJET PRINTING DEVICE

BACKGROUND OF THE INVENTION

1. Technical Field

Embodiments of the present invention relate to the field of drop-on-demand inkjet printers.

2. Description of the Related Arts

There are several methods in the art for propelling an ink droplet from a drop-on-demand inkjet printer. These methods include piezo-electric jets, electrostatic jets and thermal or bubble jets. In general, a printer has a print-head with multiple jets (channels). Most printers also pack the multiple channels close together to enhance printing speed and printing quality. However, this requirement leads to a problem known as crosstalk in many printers. Crosstalk is caused by a coupling of energy between firing channels. The energy is typically mechanical energy associated with the physical disturbance created to expel a drop or electrical energy associated with the electrical driving voltage. The effect of crosstalk is usually observed as a change in velocity and/or volume of an ejected drop of ink caused by the simultaneous firing (or prior) of one or more other channels. Crosstalk can result in degradation of print quality. There are usually several physical mechanisms by which mechanical energy is coupled from one channel into another. They could include paths through the common ink supply or paths through the common mechanical structure in the print-head. FIG. 1A illustrates a common mechanical structure of a length expander type of piezo-electric inkjet according to the prior art. As illustrated, a piezo-electric driver (e.g., transducer A 105, transducer B 110, transducer C 115, transducer D 120, transducer E 125, transducer F 130, and transducer G 135) exists for each separate transducer. Each of the transducers is in communication with the same mechanical transducer support structure 100. When a voltage is applied to a transducer or an existing voltage is rapidly changed, the transducer "fires" (i.e., rapidly elongates), extending in a direction opposite the mechanical transducer support structure 100.

When fired, the transducer's motion is coupled mechanically to all of the other transducers. This results in "structural crosstalk." In general, the crosstalk between any two channels results in changes in drop velocity and size, that can be positive or negative. However, for the length expander mechanism described above, the crosstalk between adjacent transducers is often negative. This can be seen by referring to FIG. 1B.

FIG. 1B illustrates a common mechanical structure of a length expander piezo-electric inkjet after a transducer is fired according to the prior art. The reason for negative crosstalk between adjacent transducers is illustrated by considering the common mechanical "rear mount" (i.e., the mechanical transducer support structure 100) for the transducers as a beam. When one transducer is fired, it extends in length to push against an ink chamber, thus reducing the volume of the chamber in order to expel a drop of ink. This length extension also results in a reaction force in the opposite direction on the mounting beam. The beam is therefore pushed away from the ink chambers and thus the adjacent transducers are also pulled away from their ink chambers as shown in FIG. 1B.

As illustrated, when transducer D 120 is fired, it expands in length and its lower end is initially displaced in a downward direction to drive an ink drop out of the chamber. The other end, however, is displaced in the opposite direction, pushing against the mechanical transducer support structure 100, causing it to deform. This deformation is propagated as a mechanical wave in the mechanical transducer support structure 100 and the structure undergoes a damped vibration. The mechanical transducer support structure 100 typically deforms, as it is not possible to make it completely rigid. The adjacent transducers A 105, B 110, C 115, E 125, F 130, and G 135 are also pulled upward initially because they are also attached to the mechanical transducer support structure 100. If any of the adjacent transducers are fired at the same time as D 120, the initial upward motion will subtract from the firing motion, resulting in a smaller push on the chamber, resulting in a slower, smaller drop; thus, negative crosstalk. A similar explanation applies to the refill part of the drive pulse. Accordingly, after transducer D is fired, the mechanical wave propagates through the mechanical transducer support structure 100 for a period of time (e.g., time "T") thereafter. Also, when fired, a transducer elongates and then undergoes an oscillatory expansion/contraction during the duration of the firing. These oscillations are also transmitted throughout the mechanical transducer support structure 100, and can result in structural crosstalk received by another transducer fired a short amount of time thereafter (or before), resulting in sub-optimal performance.

The mechanical wave coupling any transducer to another in the array of transducers travels at a speed determined by the geometry of the structure and the sound speed of the materials. The array of identical transducers can behave like an acoustic delay line and the mechanical wave propagation speed can be lower than the sound speed in the bulk materials. For coupling between transducers that are spaced more distantly, the mechanical disturbance may become weaker from attenuation and there may be a significant phase delay. Crosstalk between more distant transducers may therefore be weaker and, because of the phase delay, may be positive or negative. Also, crosstalk between nearby transducers firing at the same time may be changed from negative to positive and the magnitude of the crosstalk may be made stronger or weaker if a delay is introduced between the firings of the two transducers.

The above explanation of how crosstalk may vary in strength and from positive to negative has been illustrated by reference to a particular type of structural crosstalk in a length expander piezo-electric inkjet. However a similar variation of crosstalk with distance and/or firing phase delay can occur for other crosstalk mechanisms and other types of inkjet. In particular, for most types of crosstalk mechanism in any inkjet, it may be possible to change the sign and strength of the crosstalk by changing the firing phase delay.

Some current systems seek to minimize the effects of crosstalk by firing alternate channels after a selected delay time instead of firing all at the same time. This delay would result in an error in the location of the printed dot on the paper, but the error has been compensated for by off-setting the position of the jet orifices for the delayed channels. For example, if transducers C 115, D 120, and E 125 are all to be fired, rather than firing all at the same time, one can be fired before the others. Some systems fire the even transducers, then delay for a period of time, T/2, before firing the odd transducers. So the transducer D 120 would be fired, and after a (T/2) delay, transducers C 115 and E 125 would be fired.

The time, T, is the shortest time between possible firings of the same transducer. In this scheme, the delay period is chosen to be T/2 because that is the maximum period for separating the firings of adjacent channels. If T is large, then the delay time, T/2, may be sufficiently large that the crosstalk between adjacent channels may be small. However, a large value for T means that the maximum jet firing repetition rate would be low. Low firing repetition rates may not be desirable because the printing speed may be limited. Another disadvantage of the delay time T/2 is that this would result in a relatively large drop placement error so a corresponding orifice off-set correction may be needed.

The above scheme is referred to as a two phase delayed firing system. In other systems, the channels are grouped in threes with a delay of T/3 between adjacent channels in each group (3 phase delayed firing). According to such systems, transducer C 115 would be fired, then after a (T/3) delay, transducer D 120 would be fired, and then after another (T/3) delay (i.e., 2T/3 after firing transducer C 115), transducer E 125 would be fired. Four phase delayed firing systems have also been tried. The four phase firing system is designed according to the same principle as the two and three phase systems; that is the channels are divided into groups of four adjacent channels. Each channel in a group of four is fired at a time that is a multiple of T/4 different from its neighboring channel in the group.

However, such systems still typically experience much crosstalk because the timing of the delay is not optimized. In such systems, the delays are obtained by dividing the time, T, into n equal increments where n is the number of phases. The objective is to minimize crosstalk by separating the firing times of adjacent channels by as much as possible. However, in most cases, T is not sufficiently large and the mechanical wave is often still propagating throughout the print-head or ink passages even after a T/n delay, typically resulting in reduced but still unacceptably large crosstalk. Current systems are therefore deficient because they are not optimized to minimize crosstalk.

Other methods of reducing crosstalk include design changes made to the print-head. These methods are normally directed at just one mode of crosstalk and the design changes required often involve a compromise which may adversely affect other performance aspects of the print-head. The method of optimizing the delay between firing phases avoids these problems and can be used to reduce crosstalk on any print-head.

Another problem with prior methods is due to the length of the delay between the firings. Specifically, because the delay between firings can be long relative to the movement of the entire print-head, delaying a channel typically results in a displacement error of an ink droplet onto the paper. To minimize this error, current systems shift the orifice for an ink droplet to be produced in a horizontal direction away from the direction of movement of the print head. In other words, if the print-head in moving toward the right of a page, the orifice for a droplet to be produced is moved to the left. Because of print-head moves even though a droplet is delayed, the ink drop will be printed to the right of where it should be printed unless the orifice is moved to the left. However, moving such orifices adds an extra cost and layer of complexity to the manufacturing of the inkjet printing system.

DETAILED DESCRIPTION

Embodiments of the invention are directed to an inkjet printer. The inkjet printer may include an array of transducers, each of which may rapidly change the volume of an ink chamber so as to expel an ink drop when a voltage is applied thereto. The embodiment may be an inkjet printer designed to minimize crosstalk between transducers. To minimize such crosstalk, a predetermined delay may be inserted between the firing of transducers. For example, if the inkjet has a linear array of 50 transducers, and all transducers are to be fired while a given object is printed (e.g., a solid block being printed), there may be significant crosstalk between the transducers if all transducers are fired simultaneously. To reduce the amount of crosstalk, some of the transducers may be fired at once, and then the remaining transducers may be fired after a predetermined delay. The delay may be determined by calculations based on predetermined crosstalk characteristics.

For example, all of the odd transducers (e.g., transducers 1, 3, 5, . . . , 49, in a set of 50 transducers) may be fired, and then after the delay, all even transducers (e.g., transducers 2, 4, 6, . . . 50, in a set of 50 transducers) may be fired. Such delay scheme is known as a 2-phase firing scheme. In an alternate 3-phase scheme, a first third of the transducers may be fired (e.g., transducers 1, 4, 7, . . . , 49, in a set of 50 transducers), and then after a delay, the second third of the transducers may be fired (e.g., transducers 2, 5, 8, . . . , 50, in a set of 50 transducers), and then after a second delay, the remaining third of the transducers may be fired (e.g., transducers 3, 6, 9, 48, in a set of 50 transducers). Other delay schemes such as 4-phase, 5-phase, etc. may also be utilized.

Because the delay selected may be quite small, and smaller than ½ T, the 2-phase delay time period used in the prior art, the inkjet printing system may be operated without having to move the orifices for delayed channels, as is done in the prior art. Instead, because the delay is very small, the droplet displacement is small enough.

Figure 1A:
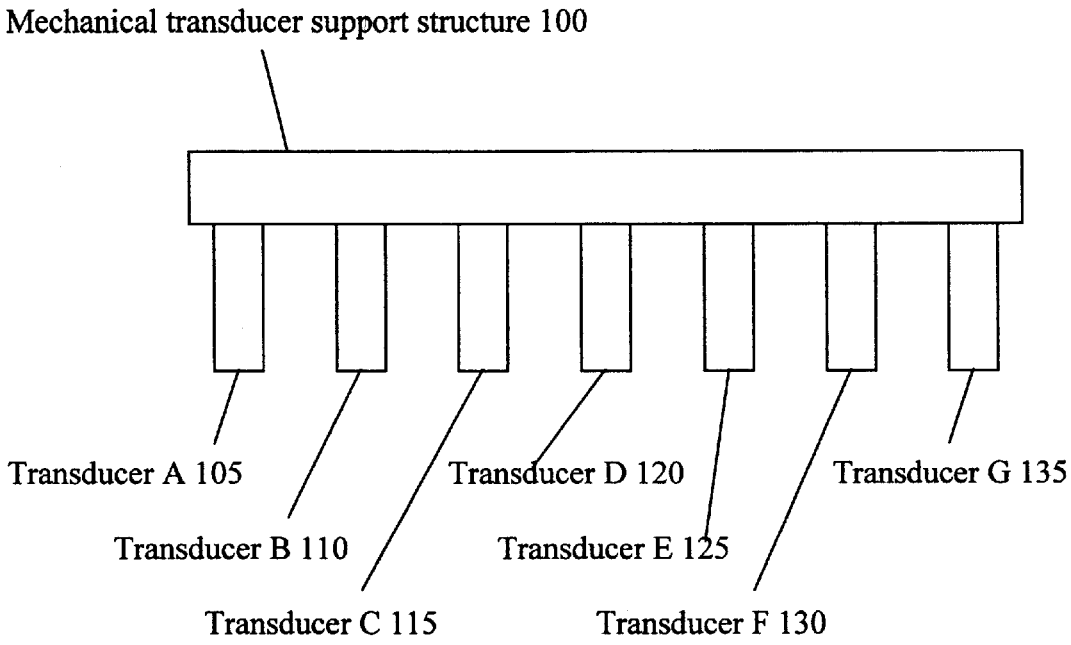
FIG. 1A Prior Art
FIG. 1A illustrates a common mechanical structure of a length expander piezo-electric ink jet according to the prior art.
Figure 1B:
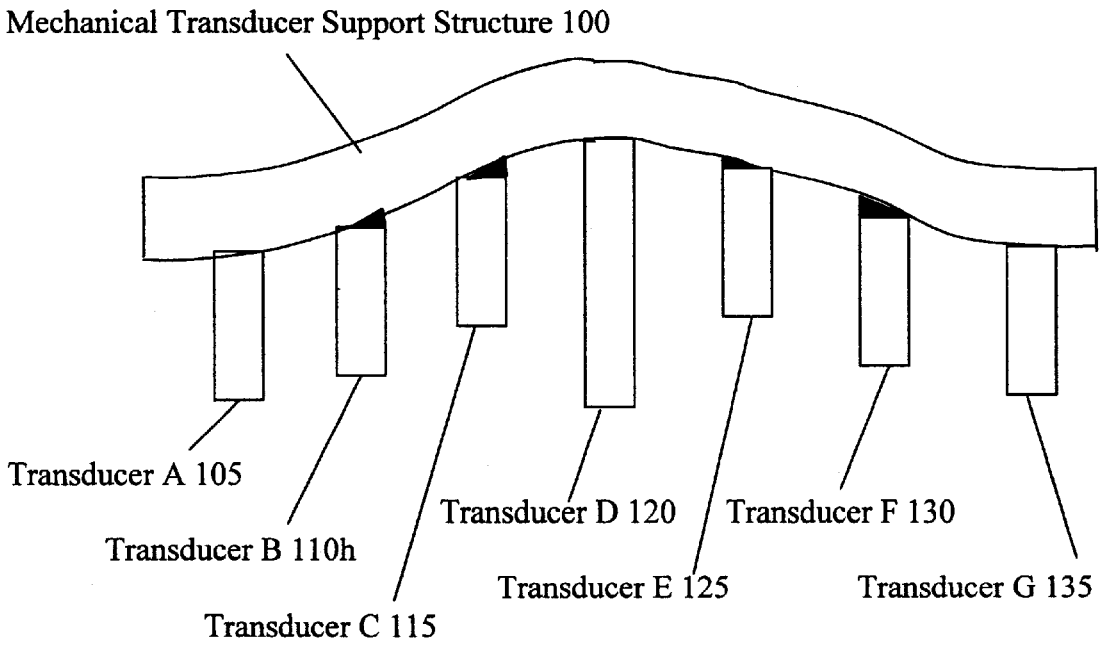
FIG. 1B Prior Art
FIG. 1B illustrates a common mechanical structure of a length expander piezo-electric inkjet after a transducer is fired according to the prior art.
Figure 2:
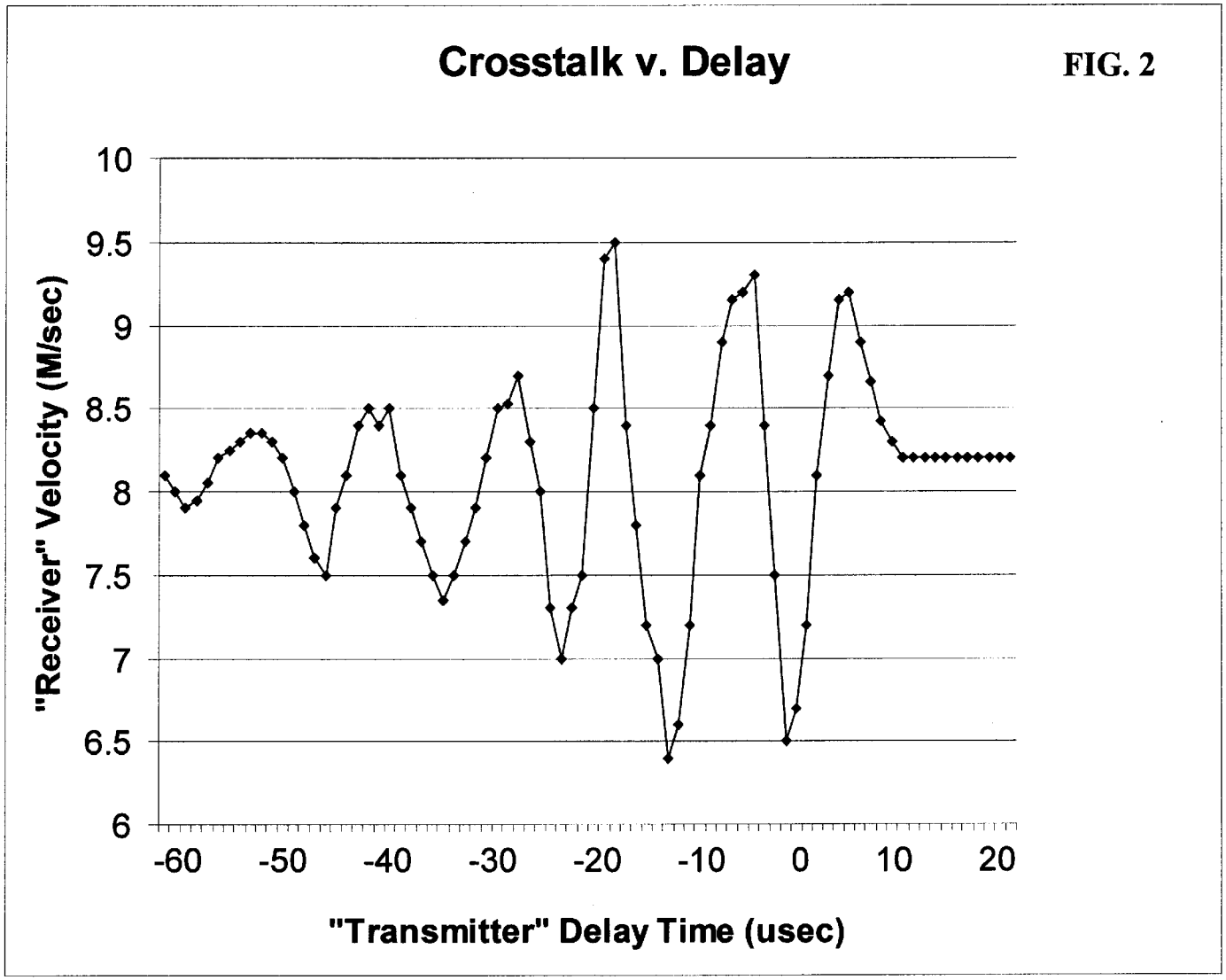
FIG. 2 illustrates a graph plotting crosstalk, as measured from drop velocity change, versus firing delay.

FIG. 2 illustrates a graph plotting crosstalk, as measured from drop velocity change, versus firing delay. The graph in FIG. 2 shows the velocity of a transducer being fired (i.e., the "receiver" transducer) at a time later than another transducer (i.e., the "transmitter" transducer) that is fired at time t=0 usec If a first transducer is fired at time "0 sec", and a second transducer is fired within a certain time period before or after, the second transducer may experience crosstalk due to the first transducer's firing. In other words, if there were no crosstalk effect, the graph in FIG. 2 would include a straight line at 8.2 M/sec across all time periods. However, as shown, the velocity may vary considerably from 8.2 M/sec.

The fractional change in velocity from 8.2 M/sec is taken as a measure of the crosstalk. In a similar way, other data such as the fractional change in drop size, may also be used to measure crosstalk. In general, the value of crosstalk as measured by drop size change may not be exactly the same as the crosstalk as measured by drop velocity change. However, any change in delay time that produces a change in crosstalk as measured by a velocity change will produce the same trend in the crosstalk as measured by any other drop parameter. The calculations of crosstalk discussed herein are all shown based on drop velocity data. However, it should be understood that they may also be based on any other drop parameter such as, e.g., drop weight that changes in response to the firing of other channels.

If the receiver transducer is fired a sufficient length of time after the transmitter was fired, then there will be no, or a negligible amount of, crosstalk. However, if the receiver transducer is not fired a sufficient length of time before or after the transmitter transducer, then crosstalk will affect the firing speed of the receiver transducer. FIG. 2 illustrates time in micro-seconds (usec) on its horizontal axis, and velocity in meters/second (M/sec) on the vertical axis. As shown, the plot time range is from −20 usec to +60 usec. At time 0, both the transmitter and the receiver transducers are fired simultaneously. As indicated in FIG. 2, at time 0, the receiver transducer has a velocity of only 6.7 M/sec. Accordingly, negative crosstalk is present because the velocity of the receiver transducer is less than the velocity would have been if there had been no crosstalk (i.e., 8.2 M/sec).

The negative time values indicate that the receiver transducer is fired before the transmitter transducer. Even though the receiver transducer is fired before the transmitter transducer, the receiver transducer may still experience some crosstalk. As illustrated, the receiver velocity between −9 and −3 usec is greater than the receiver velocity when no crosstalk is present. Accordingly, there is positive crosstalk between −3 and −9 usec. However, there is negative crosstalk between −2 and 0 usec. The reason why the receiver transducer experiences crosstalk even if fired before the transmitter is because, after the receiver transducer is fired, it takes a certain amount of time for the ink to leave an ink chamber in communication with the receiver transducer. For a period of time after firing, the ink droplet is in flight towards a piece of paper, or other media on which the ink is printed. During the first part of this time period, the ink droplet may be connected by a ligament of ink with the ink remaining in the ink chamber. While the ink droplet is thus still in communication with ink in the chamber, it may be susceptible to any disturbance (crosstalk) in the print-head. As shown in the example in FIG. 2, crosstalk may occur provided the receiver transducer fires less than 12 usec before the transmitter transducer. However, if the receiver is fired 12 usec or more before the transmitter transducer, the receiver transducer experiences no crosstalk. Therefore, if the transmitter and receiver transducers are close together, the time after firing for which the receiver is susceptible to crosstalk is approximately 12 usec.

The positive values of the time axis represent times at which the receiver transducer is fired after the transmitter transducer. As illustrated in the example in FIG. 2, crosstalk is present even if the receiver transducer is fired 60 usec after the transmitter transducer has fired. The crosstalk generated by the transmitter transducer exhibits wave-like properties. Immediately after the transmitter is fired, negative crosstalk is experienced by the receiver transducer (e.g., between 1 and 2 usec), and then the crosstalk oscillates to a positive crosstalk (e.g., between 3 and 8 usec), and then back to negative (e.g., between 9 and 15 usec), and then positive (e.g., between 16 and 19 usec), etc.

Crosstalk graphs similar to FIG. 2 can be constructed for the receiver transducer and each of the other "transmitter" transducers in the print-head. Each of these graphs also exhibit wave-like properties and generally, for more distant transducers, the crosstalk becomes more attenuated and also is shifted in time because of the time taken for the crosstalk disturbance to travel through the print-head. The total crosstalk at the receiver when all channels are firing will be the combined result of each of the effects of a single transmitter. If the crosstalk from each single transmitter is not too large, the combined effect can be obtained by algebraically adding the effects from each of the individual transmitters. In algebraic addition, a negative crosstalk contribution added to a positive crosstalk contribution results in some "cancellation" and hence a reduction in total crosstalk. An embodiment of this invention relies on maximizing the degree of cancellation by the best choice of delay time between different phase groups of channels. The optimal delay may be a delay shorter than ½ of the period, T, the delay being selected to minimize the average effect of crosstalk on all of the phase groups. Accordingly, whereas the prior art teaches alternating the firing of adjacent transducers to minimize the crosstalk at a constant amount (e.g., in a 2-phase system, firing odd transducers ½ of the firing period after firing the even transducers, or in a 3-phase system, firing the first third of the transducers (e.g., transducers 1, 4, 7), then firing the second third of the transducers (e.g., transducers 2, 5, 8) after a ⅓ period delay, and then firing the final third of the transducers (e.g., transducers 3, 6, 9)), crosstalk may be minimized by selecting a different delay amount which results in less crosstalk.

When the crosstalk versus delay data is known or determined (such as that shown in FIG. 2), for a receiver and each of the other transmitter channels, the total crosstalk in a two phase system may be calculated by adding the contributions from each of the firing channels. This may be done as a function of the delay between the two phases. A value of crosstalk for each channel may then be determined for any given pattern of channels firing. A method defining some type of weighted average for the crosstalk can be selected and a calculation made to determine the value of delay needed to minimize this weighted average. A more precise calculation may also be made to take into account previous firings of channels. For example all firings within the previous 200 usec may be included. This calculation may be done rapidly during printing by a micro-processor using previously obtained crosstalk data for the print-head stored in a memory device. The optimum delay is then set in a crosstalk controller which inserts the delay just before each firing. If it is assumed that all channels are identical, then the calculation can be simplified to obtain just two values of crosstalk, one for the even channels and one for the odds instead of individual calculations for each channel.

Table 1 below illustrates additional exemplary sample delay test data (different than the data for FIG. 2) for different delay values for a 2-phase transducer firing system.

TABLE 1

Optimum Delay Time for 2-Phase Delay

| Delay (usecs) | Velocity (M/sec) | % Crosstalk | Figure of Demerit |
|---|---|---|---|
| +1 | 3.80 | −35 | 25 |
| −1 | 4.99 | −15 | |
| +2 | 3.83 | −35 | 20.5 |
| −2 | 6.21 | +6 | |
| +3 | 4.21 | −28 | 15.5 |
| −3 | 6.03 | +3 | |
| +4 | 3.54 | −40 | 26.5 |
| −4 | 6.62 | +13 | |
| +5 | 3.74 | −36 | 28 |
| −5 | 7.04 | +20 | |
| +6 | 4.16 | −29 | 17 |
| −6 | 6.20 | +5 | |
| +7 | 4.31 | −27 | 22.5 |
| −7 | 4.83 | −18 | |
| +8 | 5.04 | −14 | 18 |
| −8 | 4.57 | −22 | |
| +9 | 5.75 | −2 | 13.5 |
| −9 | 4.42 | −25 | |
| +10 | 5.59 | −5 | 18 |
| −10 | 4.08 | −31 | |
| +11 | 5.14 | −13 | 23.5 |
| −11 | 3.90 | −34 | |
| +12 | 4.86 | −17 | 23.5 |
| −12 | 4.10 | −30 | |
| +13 | 4.88 | −17 | 24.5 |
| −13 | 4.01 | −32 | |
| +14 | 4.97 | −15 | 21.5 |
| −14 | 4.26 | −28 | |
| +15 | 4.92 | −16 | 14 |
| −15 | 5.18 | −12 | |
| +16 | 4.94 | −16 | 10 |
| −16 | 6.13 | +4 | |
| +17 | 4.98 | −15 | 9 |
| −17 | 6.08 | +3 | |
| +18 | 5.00 | −15 | 8.5 |
| −18 | 6.01 | +2 | |
| +19 | 4.98 | −15 | 7.5 |
| −19 | 5.86 | +0 | |
| +20 | 4.87 | −17 | 14.5 |
| −20 | 5.19 | −12 | |
| +21 | 5.88 | 0 | 11.5 |
| −21 | 4.54 | −23 | |
| +22 | 5.88 | 0 | 11 |
| −22 | 4.58 | −22 | |
| +23 | 5.88 | 0 | 13 |
| −23 | 4.35 | −26 | |
| +24 | 5.88 | 0 | 17 |
| −24 | 3.89 | −34 | |
| +25 | 5.88 | 0 | 16.5 |
| −25 | 3.95 | −33 | |
| +26 | 5.88 | 0 | 13.5 |
| −26 | 4.29 | −27 | |
| +27 | 5.88 | 0 | 14 |
| −27 | 4.22 | −28 | |
| +28 | 5.88 | 0 | 12.5 |
| −28 | 4.42 | −25 | |
| +29 | 5.88 | 0 | 7 |
| −29 | 5.03 | −14 | |
| +30 | 5.88 | 0 | 4 |
| −30 | 5.42 | −8 | |

To calculate the values for Table 1, all the even transducers were fired, then after the delay, all of the odd transducers were fired. "Xtalk" represents a measurement of crosstalk. The "figure of demerit" represents the measure of crosstalk over all transducers. The figure of demerit may be obtained by taking the average of the two moduli (i.e., absolute values) of the % crosstalk (i.e., the absolute value of the % crosstalk) for the even transducers and the odd transducers. There are additional ways of calculating the figure of demerit. For example, because positive crosstalk may be considered to be less detrimental than negative crosstalk, a method of weighting the positive crosstalk downward before averaging may also be used. An additional way may be to take the greatest of the numerical values of the % crosstalk (e.g., for the +1/−1 usec delay above, use "35" as the figure of demerit instead of the average of "35" and "15"). Generally, lower figures of demerit may be obtained with longer delays but there may be disadvantages associated with the longer delays such as, e.g., a slower printing system.

Figure 3:
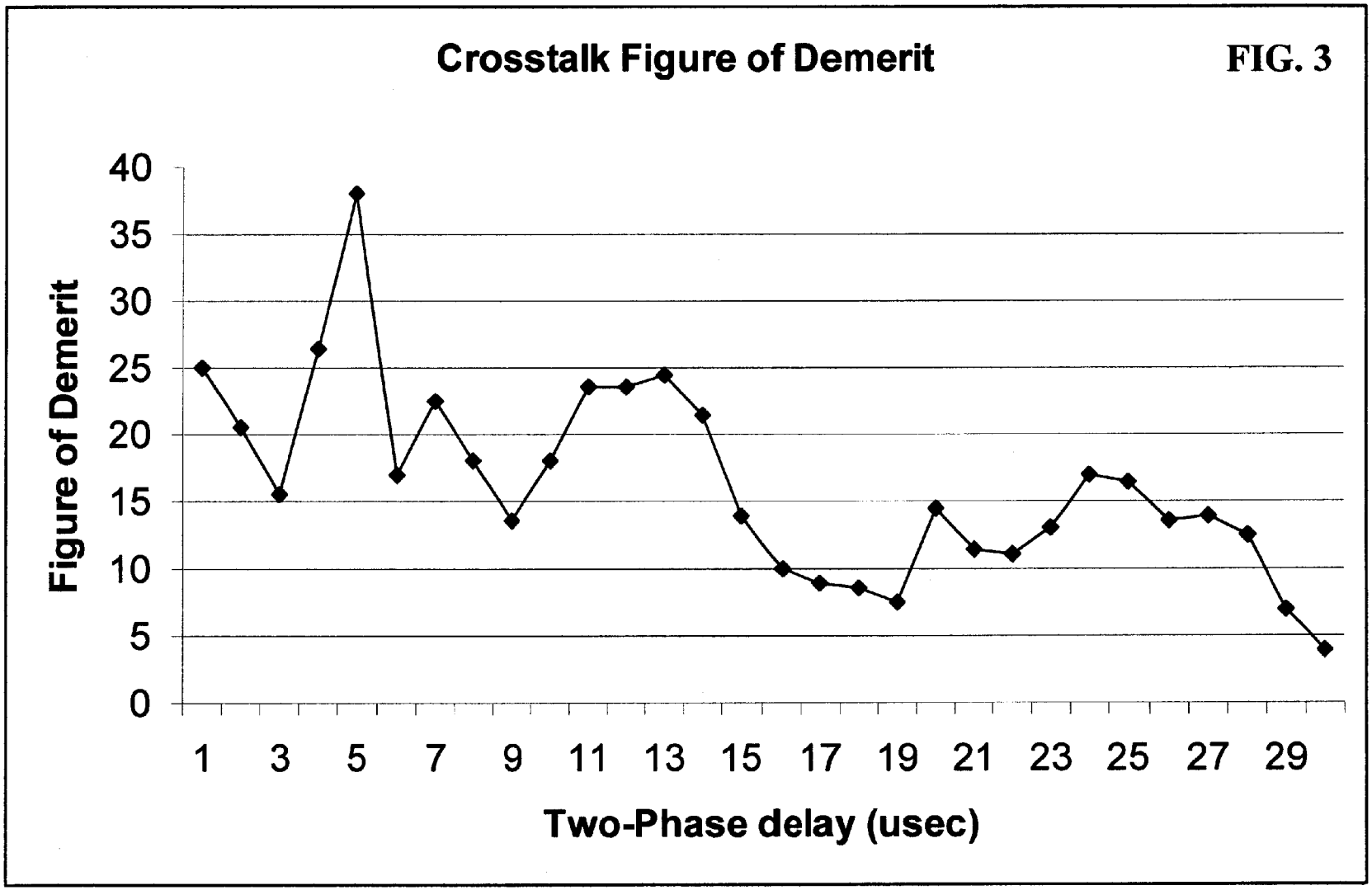
FIG. 3 illustrates a plot of figures of demerit versus delay time.

FIG. 3 illustrates a plot of the figures of demerit of Table 1 versus delay time. As shown, there are several troughs on the curve, such as those at the following delays: 3, 6, 9, 19, and 30. Accordingly, by selecting one of the delays resulting in a trough, crosstalk can be systematically minimized. For the data in Table 1 and FIG. 3, the transducers have a firing frequency of 10,000 fires/sec. Accordingly, the firing period is $1/10{,}000$ sec, or 100 usec. According to systems of the prior art, a delay of ½ of the firing period (i.e., 50 usec) would be utilized. Although Table 1 only contains data for delays up to +1/−30 usec, the velocity of the transducer at −50 usec has been measured as about 4 M/sec, resulting in −32% crosstalk, as show in Table 2 below. Therefore, since the crosstalk characteristics (e.g., the crosstalk vs. delay statistics) of the inkjet system are known, delays may be selected to minimize the crosstalk and the delay, resulting in superior printing performance.

TABLE 2

Calculated Crosstalk for Various Delay Values

| Delay | Velocity (M/sec) | % crosstalk |
|---|---|---|
| All (no delay) | 3.47 | −41 |
| Standard alternate transducer firing (−50 usec delay) | 4.0 | −32 |
| Alternate delay (+6 usec) | 4.16 | −29 |
| Alternate delay (−6 usec) | 6.20 | +5 |
| Alternate delay (+19 usec) | 4.98 | −15 |
| Alternate delay (−19 usec) | 5.86 | 0 |

Based on the data above in Table 1, the delays may be selected to maximize performance. Accordingly, in a 2-phase system, a delay of +/−3 usec may be selected if the speed of operation of the inkjet is of critical concern. However, a delay of +/−19 usec results in a smaller amount of crosstalk, but may slow performance of the inkjet to an unacceptable speed. If the +/−19 usec delay is acceptable, then it may be selected as the delay. Accordingly, the inkjet printer may operate more quickly and with less crosstalk with a +/−19 usec delay than an inkjet utilizing 50 usec delays.

For a three-phase embodiment, different delay values may be utilized to minimize the crosstalk. For example, the figure of demerit and % crosstalk values similar to those in Table 1 may be calculated based on a three-phase system. The delays for the three phase system may then be selected. For example, if a +/−15 usec delay is optimal, then, e.g., transducers N, N+3, N+6, etc. may be fired at time "0", and transducers N+1, N+4, N+7, etc. may be fired at time "15 usec", and transducers N+2, N+5, and N+8 may be fired at time "−15 usec".

Although the examples shown above list various delay values, the optimal delay values may vary, depending on the intended application. For example, different delay values may be appropriate in systems having higher transducer firing frequencies. Also, other variables, such as the paper gap and the paper speed, may also have an impact on the appropriate delay required.

Figure 4:
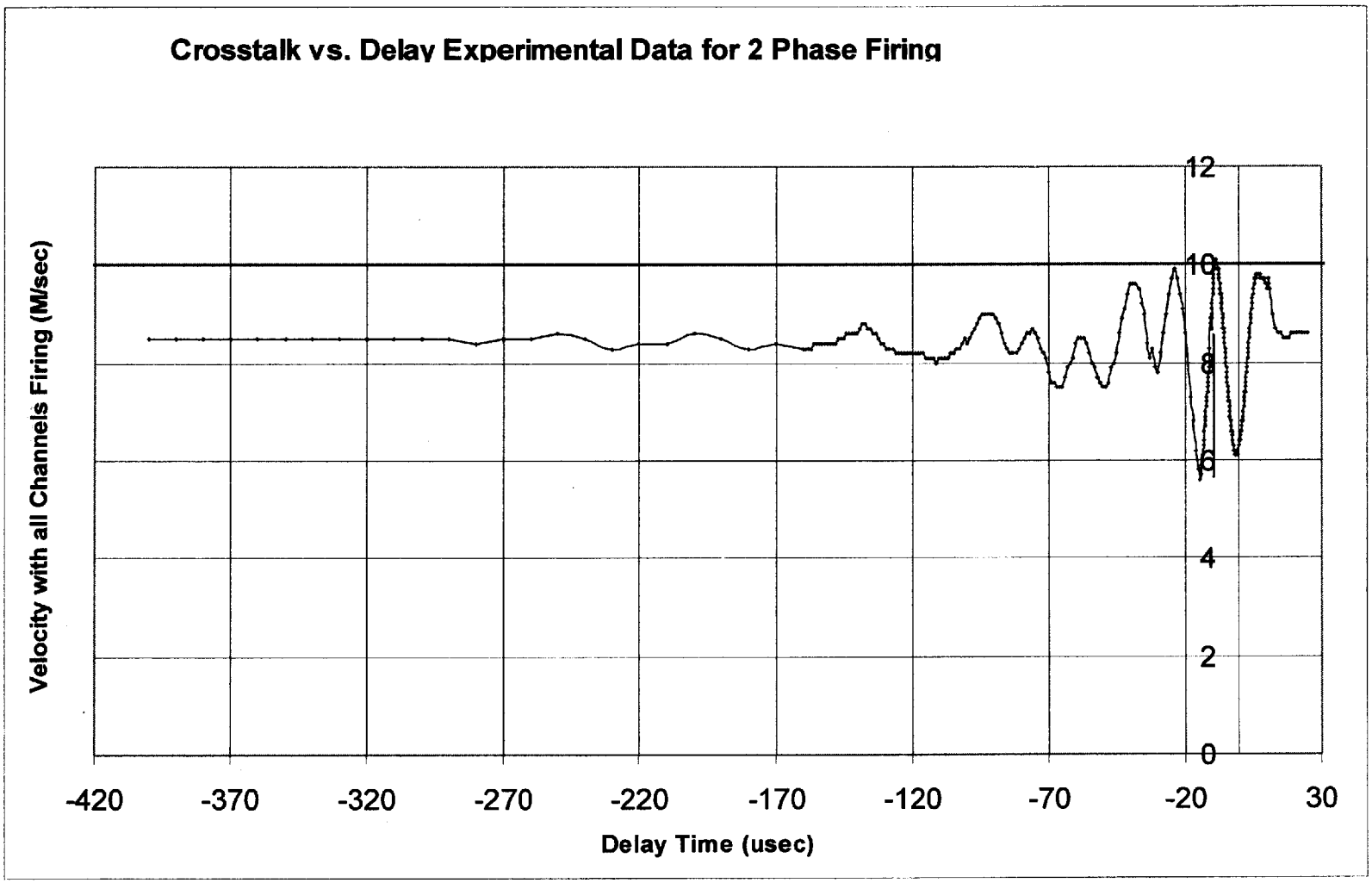
FIG. 4 illustrates a graph showing the result of adding the crosstalk contributions for a receiver in the centre of an array with all channels in the array firing according to an embodiment of the invention.

FIG. 4 illustrates a graph showing the result of adding the crosstalk contributions for a receiver in the centre of an array with all channels in the array firing according to an embodiment of the invention. The data was obtained from tests similar to those which resulted in the data shown above in FIG. 2. Specifically, this data was obtained with two phase firing and the delay between phases is shown plotted on the abscissa. The print-head from which this data was obtained was a piezo-electric length expander device and the receiver channel firing was set for a drop velocity of 10 M/sec when firing alone. As shown in FIG. 4, there is a dominant oscillation in the curve with a period of about 17 usec. This corresponds to a frequency of about 60 kHz which was close to an internal fluidic resonance, the Helmholtz resonance, in this print-head. This 16 usec period also shows up in the calculation of a "figure of demerit" as a function of delay (see FIG. 5).

Figure 5:
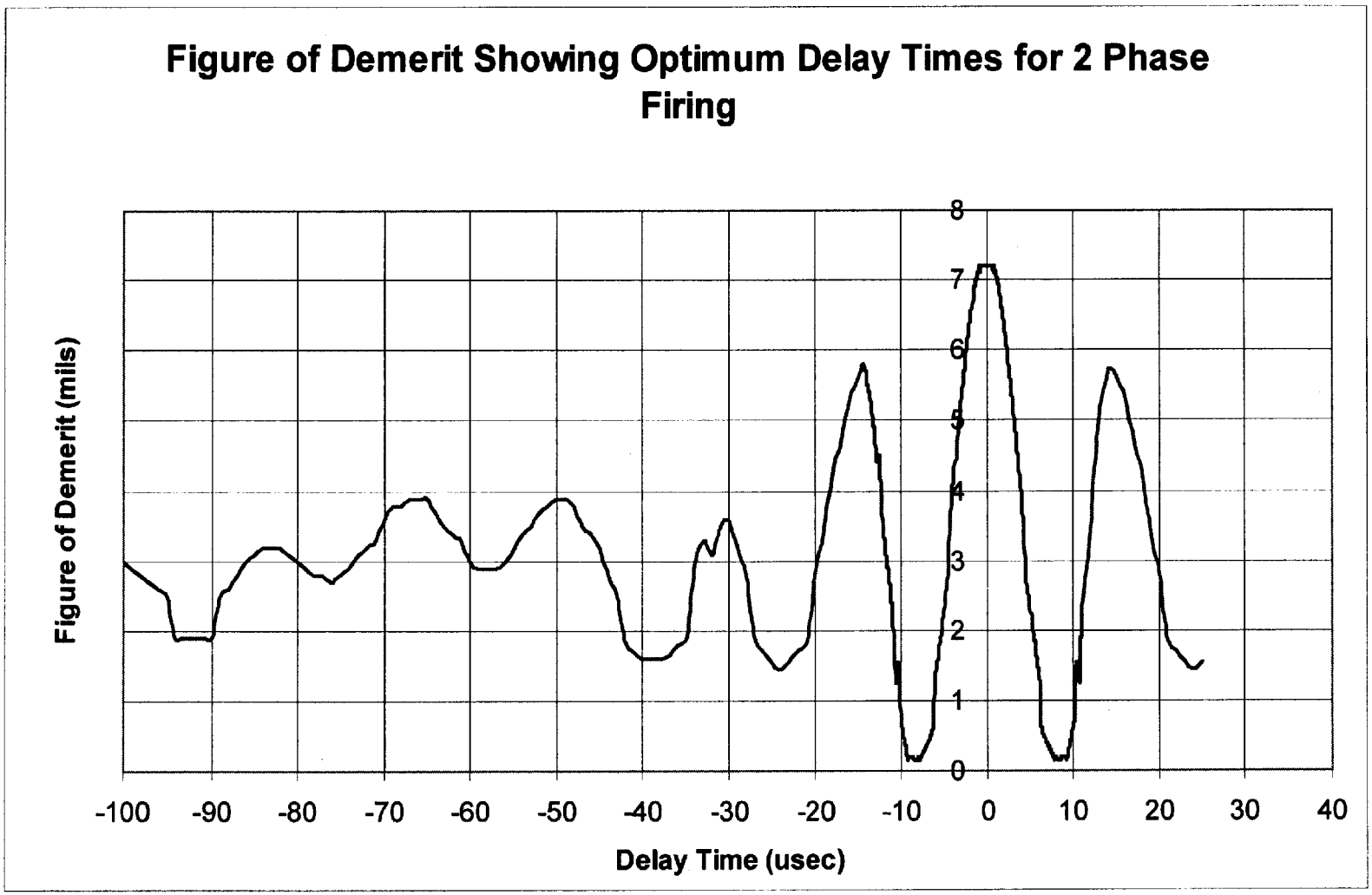
FIG. 5 illustrates a graph of the figure of demerit based on the crosstalk vs. delay data shown in FIG. 4.

FIG. 5 illustrates a graph of the figure of demerit based on the crosstalk vs. delay data shown in FIG. 4. The "figure of demerit" shown in FIG. 5 was calculated according to a different method than was the figure of demerit shown in FIG. 3 and listed in Table 1 above. In both cases, the "figure of demerit" is intended to be a measure of how bad the crosstalk is. It is necessary to do something like this because when delays are used, each phase has a different value for the crosstalk. Also, negative crosstalk is generally worse than the same percentage positive crosstalk. For the "figure of demerit" used in Table 1 (for 2-phase), the first simple idea was used in which the 2 moduli (i.e., absolute values) of crosstalk were simply averaged. In the explanation below, it is noted that some type of weighting in the averaging to favor positive crosstalk might yield better results. Accordingly, the calculate the figure of demerit as graphed in FIG. 5, such a weighted average was utilized.

First, the average dot location error caused by crosstalk was calculated—this automatically takes into account the fact that positive crosstalk is not as bad as negative crosstalk. It also has the advantage that the "figure of demerit" now has a physical significance—it is the average dot placement error and the units in FIG. 5 are mils (0.001 inch). However before plotting FIG. 5 one further refinement was made to the "figure of demerit", to reflect that the ultimate goal is to maximize the perceived print quality. Dot displacement detracts from print quality but probably not in a linear way. To truly take this into account it is more difficult than simply adjusting the way in which the averaging is done but, to get into a very difficult area. Also, the fact that crosstalk also changes the dot size and maybe shape is ignored. Which are also very important considerations for print quality. What was done was to take a simplistic approach in which an assumption was made that dot displacements greater than some critical value, e, would detract more from print quality than those less than e. Accordingly, the "figure of demerit", F, for n phase firing was defined as:

$$F=(w_1\Delta X_1+w_2\Delta X_2+\ldots+w_n\Delta X_n)/n$$

where n is the number of phases. For example, for the case, n=3, yields $$n=(w_1\Delta X_1+w_2\Delta X_2+w_3\Delta X_3)/3$$

where $\Delta X_n$ is the dot placement error (calculated from the crosstalk) for phase n. $w_1$, $w_2$, $w_3$ . . . $w_n$ etc. are weighting factors. To obtain the results illustrated in FIG. 5, the weighting factors are defined as follows:

$$w=1 \text{ for } \Delta X<e$$

$$w=2 \text{ for } \Delta X>e$$

For this case, e was taken to be:

e=1 mil

The ΔXs were calculated from:

$$\Delta X=(g.V_s.\Delta V)/V_d.(V_d+\Delta V)$$

where: g=paper gap (assumed=60 mils)

$V_s$=paper speed (assumed=2M/sec)

$V_d$=drop velocity with no crosstalk (assumed to be =0M/sec)

ΔV=departure of drop velocity from "no crosstalk value" −10M/sec in this case.

The parameters selected for the above calculation of the ΔXs and hence F will have an impact on the shape of the F vs. delay curve and hence may change the values for the optimum delay. In other embodiments, different values of ΔXs on print quality and hence on F may be determined.

The optimum values of delay are at the lowest values for the figure of demerit, which is a weighted average of the calculated dot displacement resulting from crosstalk. Because of the rapid 17 usec fluctuations, there is an optimum delay at the relatively low value of 8.5 usec. Unlike in prior methods, the delay between adjacent channels may no longer be the same value of T/2. For example, in the prior art 2-phase delay scheme, for a jet designed to operate at 10 kHz, the delay would have been 50 usec (half of the firing frequency) and the figure of demerit would have been about 30 times higher (worse). The delay may thus be reduced to a smaller value and optimized to obtain a greater reduction in the crosstalk.

As well as 8.5 usec, there are also several other delay times shown in FIG. 5 at which there is a minimum in the figure of demerit (minimal crosstalk)—e.g., at times 24, 39, 58, 77 and 93 usec. Accordingly, if the crosstalk versus delay characteristics of transducers are known, a short delay may be selected to allow the transducers to be fired as fast as possible while minimizing the effect of crosstalk.

Figure 6:
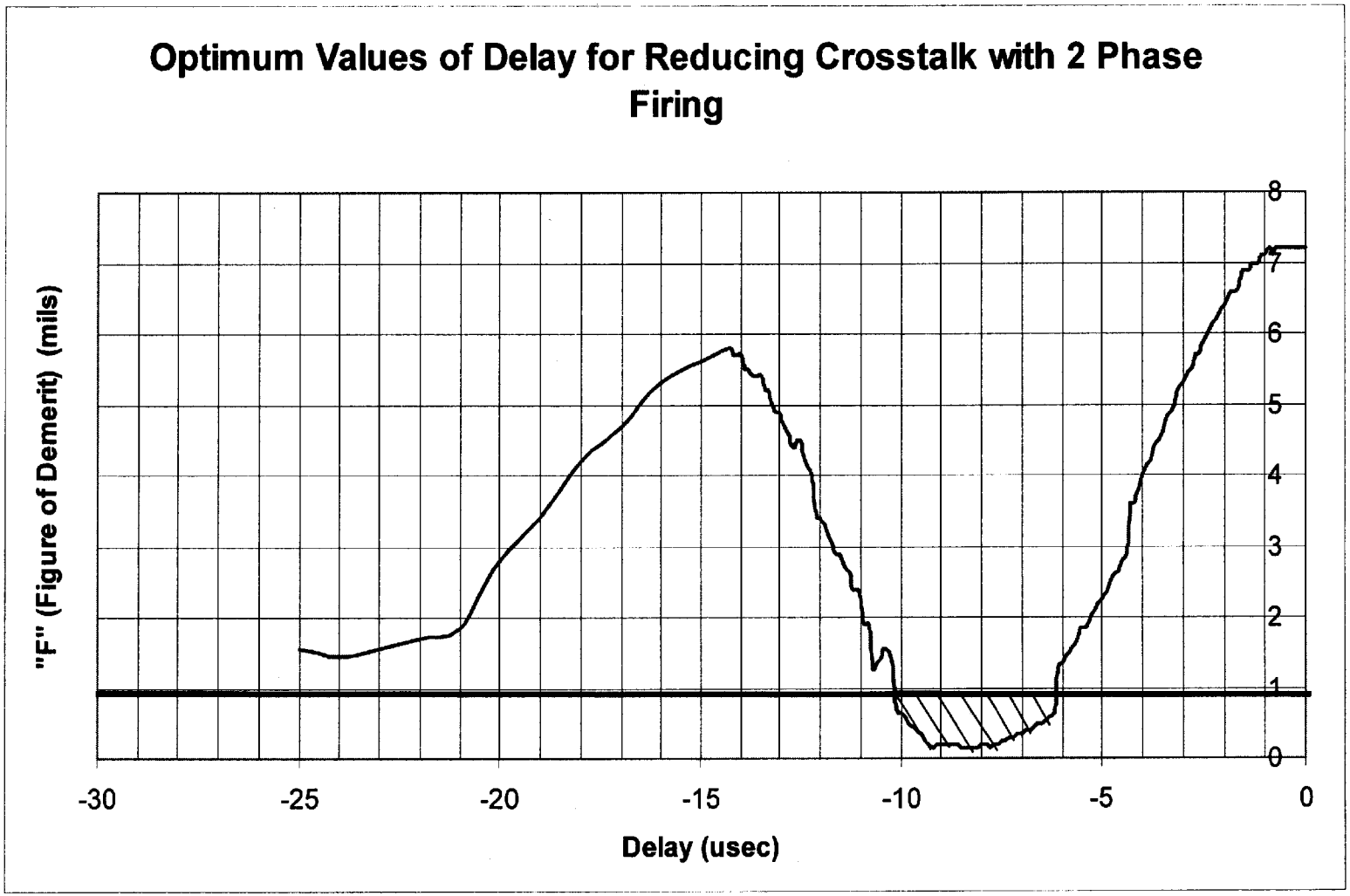
FIG. 6 illustrates an expanded view of the figure of demerit data shown in FIG. 5.

FIG. 6 illustrates an enlarged view of the figure of demerit data shown in FIG. 5. Based on this figure of demerit data, the delays are selected. As shown, the figure of demerit is lowest between −6 and −10 usec. Accordingly, a delay within this time range (e.g., 8.5 usec) may be selected to yield the smallest crosstalk.

Figure 7:
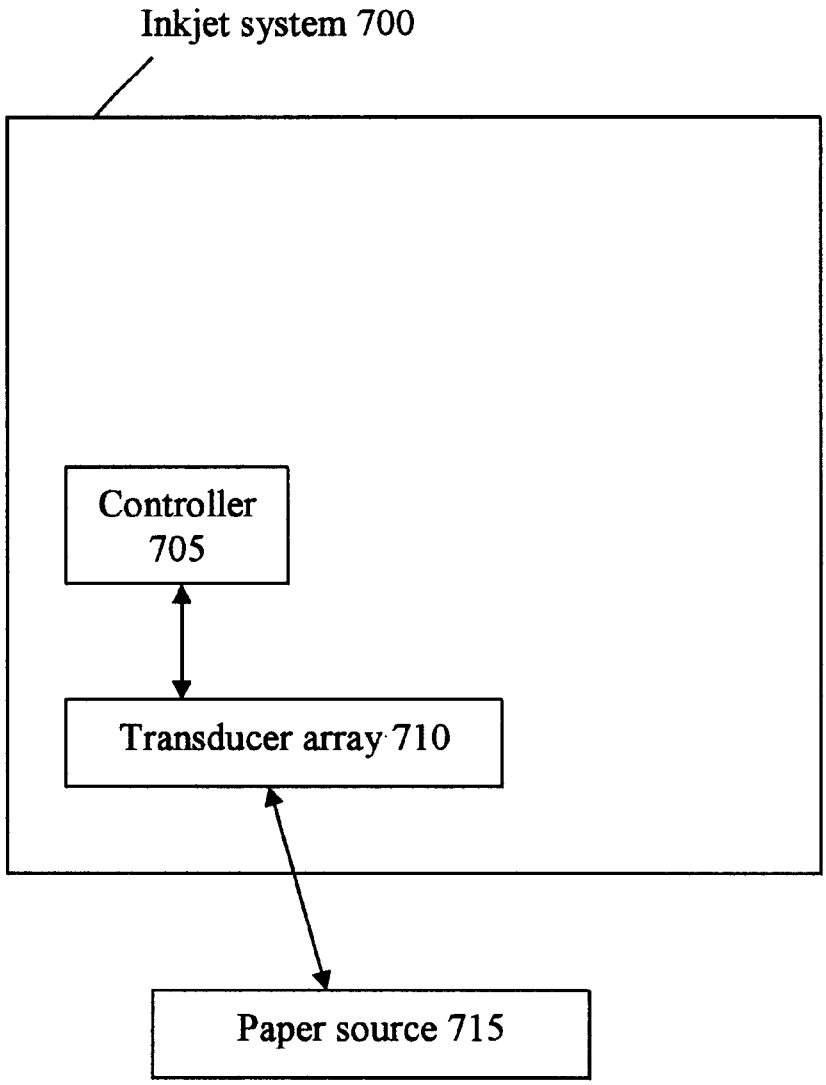
FIG. 7 illustrates a piezo-electric inkjet firing system according to an embodiment of the invention.

FIG. 7 illustrates a piezo-electric inkjet firing system according to an embodiment of the invention. As shown, an inkjet system 700 includes a controller 405 and a transducer array 710. The transducer array 710 may include an array of piezo-electric transducers, or other types of drop-on-demand transducers. The controller 705 may be utilized to fire the transducers in the transducer array 710 so that ink may be ejected onto a paper source 715. The controller 705 may insert the predetermined delay values known to minimize the crosstalk.

The previous descriptions relate to embodiments where the delay times between channels being fired are predetermined. Such embodiments determine the delays based on the assumption that all channels are equal, and that all even channels are fired, followed by all odd channels (or vice-versa). However, another embodiment may more precisely determine the optimal delay values. For example, in an embodiment having a 96-transducer array, the transducer array may be tested to determine a crosstalk versus delay curve for each transducer relative to all other transducers being fired individually. If the transducers are numbered "A1" through "A96," the crosstalk versus delay data may first be determined for transducer A1. So, crosstalk versus delay data may be determined for transducer A1 when only transducer A2 is fired. Next, crosstalk versus delay data may be determined for A1 when only transducer A3 is fired, etc., on until crosstalk versus delay data is determined for transducer Al when only transducer A96 is fired. Therefore 95 crosstalk versus delay curves may be determined for transducer Al.

95 crosstalk versus delay curves may also be determined for each of the other transducers A2–A96. Once all of the crosstalk versus delay data has been determined, it may be stored in a memory and may be utilized to determine and implement on the fly (i.e., in real-time) optimal delay values to minimize crosstalk. For example, if transducers A1, A10, and A53 are to be fired, a processor may sum the crosstalk versus delay curves for when only these three transducers are to be fired, and determine which delay values will result in the smallest crosstalk. These delay values may then be implemented.

Figure 8:
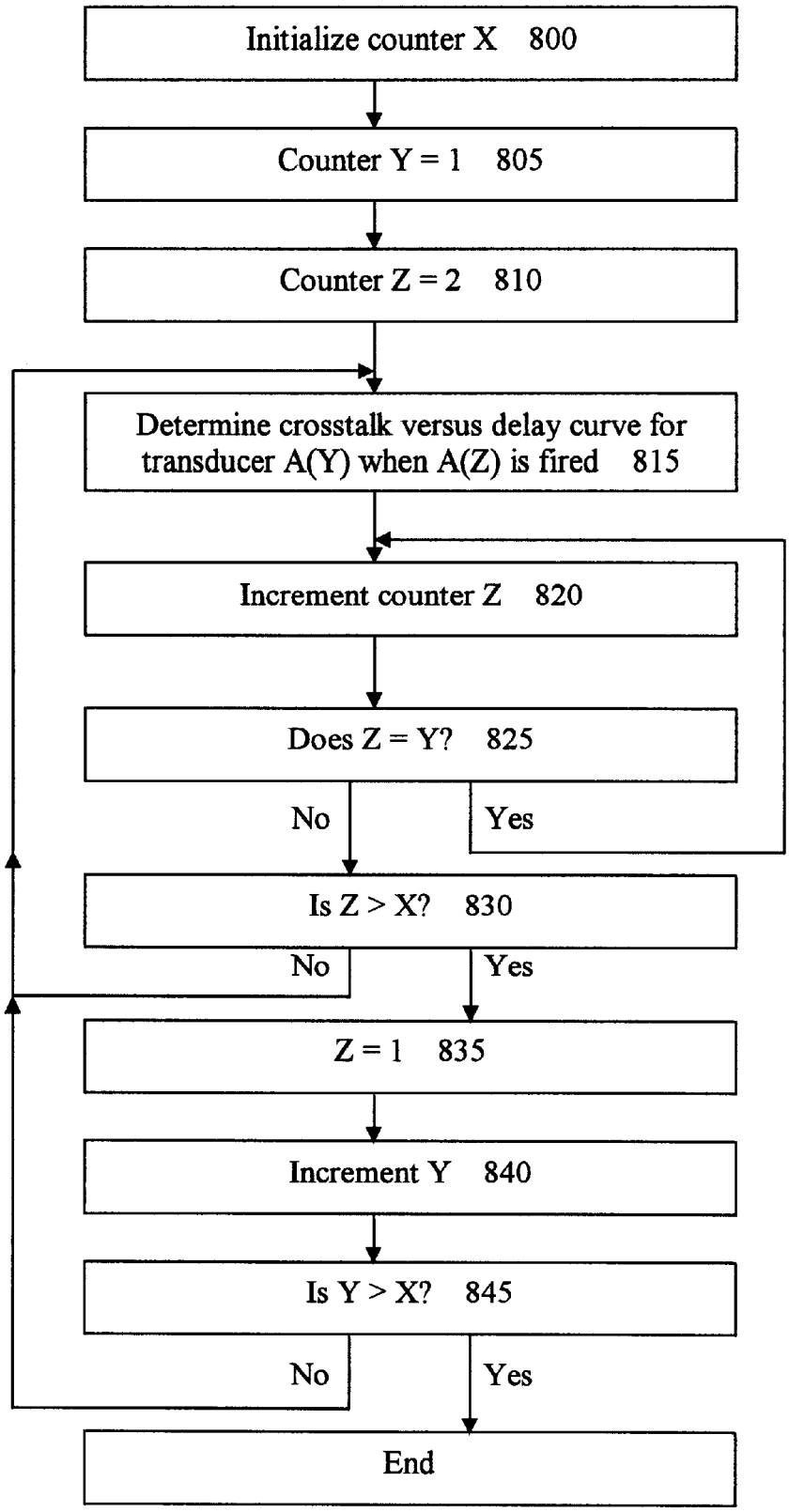
FIG. 8 illustrates a method of determining crosstalk versus delay data/curves for each individual transducer in a transducer array when each other transducer is fired individually according to an embodiment of the invention.

FIG. 8 illustrates a method of determining crosstalk versus delay data/curves for each individual transducer in a transducer array when each other transducer is fired individually according to an embodiment of the invention. First, counter X is initialized 800. If there are "96" transducers, A(1) through A(96), then X may be initialized with the value "96." Next, counter Y may be set 805 to "1." Counter Z may then be set 810 to "2."

Next, a crosstalk versus delay data/curve may be determined 815 for transducer A(Y) when only transducer A(Z) is fired. Counter Z is then incremented 820. Next, the system determines 825 whether Z is equal to Y. If "no," processing proceeds to operation 830. If "yes," processing returns to operation 820 where counter Z is incremented again. The reason why counter Z has to be incremented again is because there is no reason to determine a crosstalk versus delay data/curve for a transducer versus itself.

At operation 830, the system determines whether counter Z is greater than counter X. If "no," processing returns to operation.815. If"yes," processing proceeds to operation 835, where counter Z is set to "1." Next, at operation 840, counter Y is incremented. The system then determines 845 whether counter Y is greater than counter X. If "no," processing returns to operation 815. If "yes," then the process ends because all crosstalk versus delay data/curves have been determined.

Figure 9:
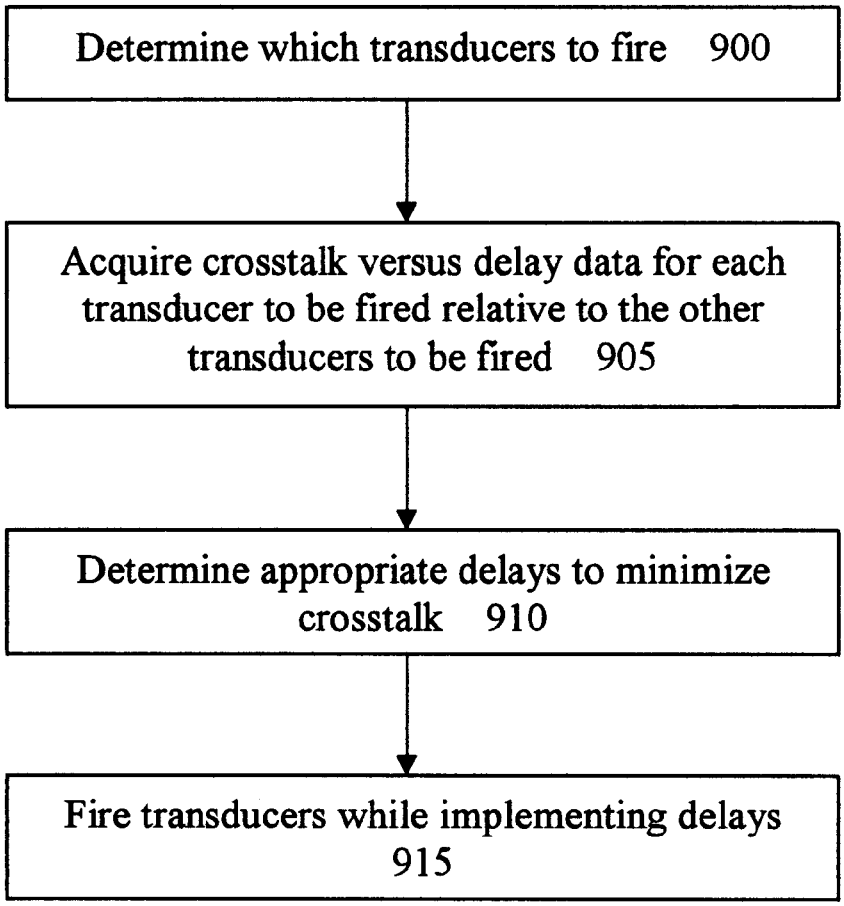
FIG. 9 illustrates a method of determining and implementing the delay values on the fly according to an embodiment of the invention.

FIG. 9 illustrates a method of determining and implementing the delay values on the fly according to an embodiment of the invention. First, the system determines 900 which transducers to fire. Next, the system acquires 905 crosstalk versus delay data for each transducer to be fired relative to the other transducers to be fired. For example, if transducers A(1), A(20), and A(53) are to be fired, then for transducer A(1), the system acquires the crosstalk versus delay data for when only transducer A(20) is fired, as well as the crosstalk versus delay data for when only transducer A(53) is fired. This data may then be summed and the appropriate delays may be determined 910 to minimize the crosstalk between the fired transducers. Finally, the transducers are fired 915 while implementing the delays.

In other embodiments, rather than calculating optimal delays for each individual transducer to be fired, the delays may be determined based on groupings of channels (e.g., all even channels to be fired, or all odd channels to be fired). For example, the delays may be determined where only a few even channels and only a few odd channels are to be fired.

Figure 10:
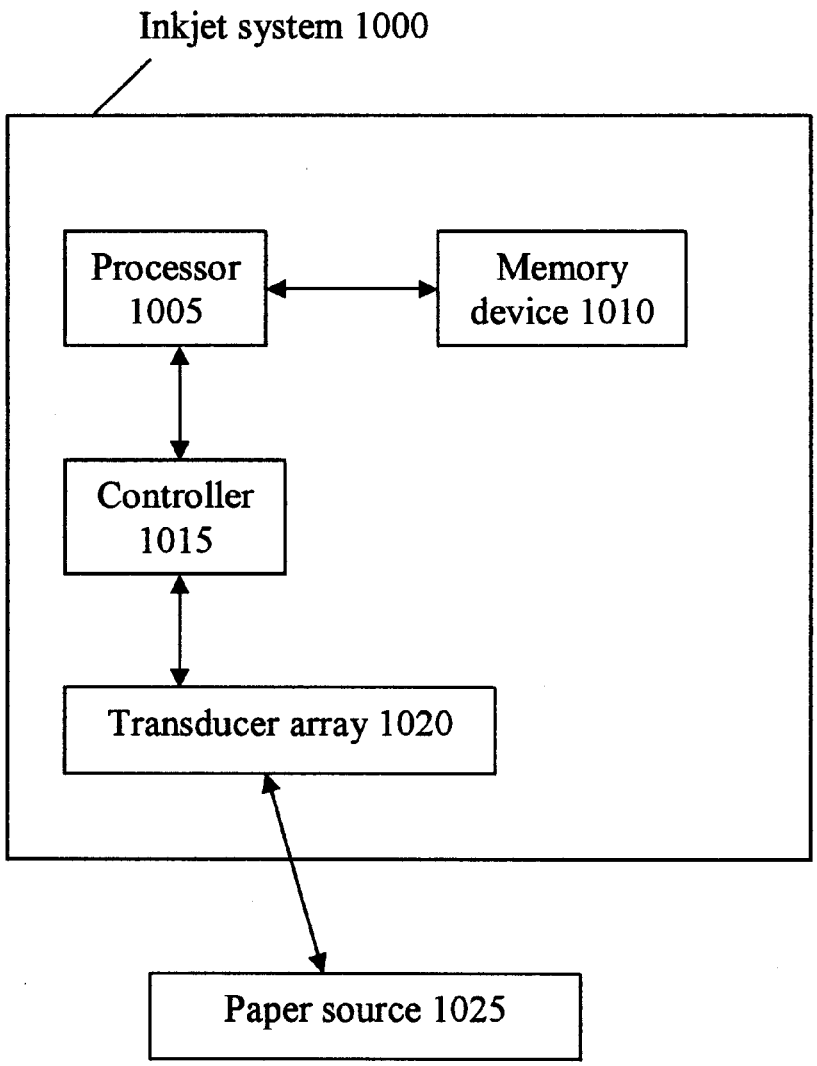
FIG. 10 illustrates an inkjet system which determines appropriate delays on the fly (i.e., in real-time) for transducers to be fired according to an embodiment of the invention.

FIG. 10 illustrates an inkjet system 1000 which determines appropriate delays on the fly (i.e., in real-time) for transducers to be fired according to an embodiment of the invention. As shown, the inkjet system 1000 may include a memory device 1010. The memory device 1010 may be an EPROM, a ROM, or any other suitable media for storing data. The memory device 1010 may store the crosstalk versus delay data described above with respect to FIGS. 8 and 9. A processor 1005 may be coupled to the memory device 1010 and may implement the method described above with respect to FIG. 9.

The inkjet system 1000 may also include a controller 1015 and a transducer array 1020. The transducer array 1020 may include an array of piezo-electric transducers or any other drop-on-demand transducers. The processor 1005 may also be in communication with a controller 1015. The controller 1015 may be utilized to fire the transducers in the transducer array 1020 so that ink may be ejected onto a paper source 1025. In other embodiments, the processor 1005 may perform these functions of the controller 1015, obviating the need for a separate controller 1015.

Although the descriptions above relate to piezo-electric length-mode expander inkjets, the teachings are also applicable to other types of drop-on-demand inkjets such as bubble/thermal inkjets and inkjets in which the drop is ejected by an electrostatic field. All inkjets have a somewhat similarly-sized ink cavity, and a relatively high Helmholtz frequency (i.e., the dominant internal resonance frequency). Accordingly, there are many different types of inkjet printing systems for which a firing delay may be selected, the delay being less that ½ T, which would result in crosstalk than would be experienced if a ½ T delay were used. Moreover, although the description is directed to 2-phase systems, the teachings are also applicable to 3-phase, 4-phase, etc., systems. In general, regardless of the number of phases, the crosstalk may be minimized be selecting appropriate delays.

The multi-phase "smart delay" firing discussed above may significantly reduce the effects of cross-talk in any print-head. Cross-talk usually impacts print quality because it results in changes in the velocity and the volume of the drop in flight which, in turn, results in dot placement error and dot size error. Cross-talk, as discussed above, causes velocity variations. The methods described above reduce velocity variations and may, in almost all types of print-heads, also reduce drop volume variations.

Cross-talk reduction may be achieved by selecting optimum values for the delay(s) between the different phases so that some cancellation occurs between positive and negative contributions to cross-talk when all transducers are firing. As discussed above with respect to FIGS. 2–10, the optimum values of delay can be calculated from experimental cross-talk data. The data needed depends on the number of phases chosen and also upon the firing frequency range over which cross-talk is to be minimized.

Calculation of Delays

In calculating the delays, several basic assumptions are made. These are listed below, and the raw experimental data needed for 2-phase, 3-phase and 4-phase firing is described below together with an outline of how this would be extended to the general case of N-phase firing. The calculation outline is given for the following cases:

(1) 2 phase low frequency (2) 2 phase high frequency (3) 3 phase low frequency, unequal delays.

(4) 3 phase high frequency, unequal delays (5) 4 phase all frequencies, delays determined from 3 parameters.

(6) N phase—general case.

Basic Assumptions (1) Cross-talk is algebraically additive. If a "receiver" channel, firing a drop with velocity, V, decreases in velocity by an amount $\Delta V_a$ when another channel, a, is fired, the cross-talk is defined as $\Delta V_a/V$. When other channels are firing, the total cross-talk, $\Delta V/V$, is given by:

$$\Delta V/V=\Sigma\Delta V_a/V$$

This is true if $\Delta V/V<<1$. This assumption has been tested and found to be reasonably good if $\Delta V/V</=0.1$.

(2) All channels are identical.

(3) The time delay, δ, between two phases is defined as the time by which a "transmitter" channel fires before a "receiver" channel. The cross-talk contribution from any channel is zero for δ>20 μsec.

(4) In these initial calculations, end channel effects are ignored. Therefore, all channels in one phase group will have identical cross-talk.

(5) When no other channels are firing, each channel is assumed to have a velocity, V, which is the same for all channels.

(6) The print-head is assumed to be a linear array of channels. For N phase firing, the channels are divided into n groups, 1,2 . . . N, each group having its own delay. Group 1 or phase 1 is defined as the first group to fire. The channels are divided into groups as follows:

$$\mathbf{1,2,3}\ldots N,\ \mathbf{1,2,3}\ldots N,\ \mathbf{1,2,3}\ldots$$

The delay between phase 1 (receiver) and phase 2 (transmitter) is $\delta_1$ and between phase 2 (receiver) and phase 3 (transmitter) is $\delta_2$ and so on.

(7) If the firing frequency, f, is sufficiently low that the effect of previous firing has no effect on any phase in the current firing, then frequency can be neglected. The minimum time, t, between adjacent firing cycles will be given by:

$$t=(1/f-\delta_{max})$$

where $\delta_{max}$ is the maximum delay between any two phases.

From experimental data, it has been determined that for t>/=300 μsec, the previous firing can be ignored. If it is assumed that $\delta_{max}$ is small, then the low frequency range will be below 3–4 kHz.

(8) Although the cross-talk with all channels firing is the same for any channel in a phase group, each phase group will, in general, have a different velocity. An overall rating cross-talk rating for the print-head is defined by a "figure of demerit", F. F is a weighted average of the dot placement errors resulting from cross-talk. The dot placement error, ΔX, is given by:

$$\Delta X=ABS[(g.V_s.\Delta V)/\{V.(V+\Delta V)\}],\ \text{where}$$

g=paper gap $V_s$=paper speed

V=no cross-talk drop velocity, and $\Delta X_N$ is the value of ΔX for phase N.

The value of F(δ1, δ2, . . . ) is given by:

$$F=(w_1.\Delta X_1+w_2.\Delta X_2+\ldots+w_N.\Delta X_N)/N,\ \text{where}$$

w is a weighting factor and δ1, δ2, . . . are the delays between the phases. The weighting factor is used to increase the impact of any ΔX on F if ΔX is greater than some selected value, e, of the maximum acceptable dot placement error. For example, if a simple linear weighting is used:

$$\text{If } \Delta X=/<e,\ w=1$$

$$\text{If } \Delta X>e,\ w=k$$

Increasing k may make F more responsive to the condition, ΔX>e. For some initial calculations, a value of k=2 may be used.

(9) It is assumed that the best values of δ will be those that give values of F less than e or, if F is always greater than e, as low as possible over a reasonably wide range of δ. The lowest value of F might not necessarily be the best choice if it occurs as a sharp minimum. This is because of considerations of variability in the data. There may also be a preference for choosing a smaller value of δ that gives a low F because the delay itself results in a dot placement error. For larger values of δ, it is necessary to correct this with an offset of the orifice position. This may require specially made orifice plates.

The above assumptions may be expressed symbolically by denoting the change in velocity caused by cross-talk, ΔV in a receiver channel in phase group, p, by all channels firing in phase groups, p, q, r . . . as $\Delta V_{(p,\ p\ \&\ q\ \&\ r\ \ldots)}$. In general, this may be a function of the values of δ between the phases.

$$\Delta V_{(p,\ p\ \&\ q)}(\delta)=\Delta V_{(p,\ p\ \&\ q)}(-\delta)$$

$$\Delta V_{(p,\ p)}=\Delta V_{(p,\ p\ \&\ q)}(\delta=20)$$

$$\Delta V_{(p,\ p)}=\Delta V_{(q,\ q)}=\Delta V_{(r,\ r)}=\ldots$$

$$\Delta V_{(p,\ p\ \&\ q\ \&\ r\ \&\ s\ \ldots)}=\Delta V_{(p,\ p\ \&\ q)}+\Delta V_{(p,\ p\ \&\ r)}+\Delta V_{(p,\ p\ \&\ s)}+\ldots-(n-2)\Delta V_{(p,\ p)}$$

For 3-phase firing, there are also additional symmetries from which it follows that, if the delay between phases 1 & 2 is δ and the delay between phases 2 & 3 is Mδ:

$$\Delta V_{(1,\ 1\ \&\ 2)}(\delta)=\Delta V_{(2,\ 2\ \&\ 3)}(M\delta)$$

$$\Delta V_{(1,\ 1\ \&\ 2)}(\delta)=\Delta V_{(1,\ 1\ \&\ 3)}(\{1+M\}\delta)$$

If the effect of firing frequency, f, is taken into consideration this is indicated symbolically by an additional bracketed suffix. Thus the ΔV in a receiver channel in phase group, p, caused by all channels firing at a frequency, f, in phase groups, p, q, r . . . is denoted as $\Delta V_{(p,\ p\ \&\ q\ \&\ r\ \ldots)(f)}$.

2-Phase (Low Frequency)

To calculate the delays, the following experimental data is needed:

(1) Using a phase-1 channel near the middle of the print head, measure velocity, V, firing alone.

(2) Measure the velocity $V_{(1,\ 1\ \&\ 2)}(\delta)$–all channels firing. Measure over a range of δ from +20 to −300 μsec.

Calculation of $F(\delta_1)$ From Input Data:

Input data is:

$V_{(1,1\ \&\ 2)}(\delta)$ and V

Paper gap, g (default 60 mils)

Paper speed, $V_s$ (default 2 M/sec)

Max. dot error, e (default 1 mil)

Linear weighting value, k (default 2)

(1) $V_{(1,1)}$ $$V_{(1,1)}=V_{(1,1\ \&\ 2)}(\delta_1=20)$$

(2) $\Delta V_{(1,1\ \&\ 2)}$ $$\Delta V_{(1,1\ \&\ 2)}=V_{(1,1\ \&\ 2)}-V$$

(3) $\Delta V_{(1,1)}$ $$\Delta V_{(1,1)}=V_{1,1}-V$$

(4) $\Delta V_{(1,2)}$ $$\Delta V_{(1,2)}=\Delta V_{(1,1\ \&\ 2)}-\Delta V_{(1,1)}$$

(5) $\Delta V_{(2,1)}$ $$\Delta V_{(2,1)}(\delta)=\Delta V_{(1,2)}(-\delta)$$

(6) $\Delta V_{(2,2)}$ $$\Delta V_{(2,2)}=\Delta V_{(1,1)}$$

(7) $\Delta V_{(2,1\ \&\ 2)}$ $$\Delta V_{(2,1\ \&\ 2)}=\Delta V_{2,1}+\Delta V_{2,2}$$

(8) $\Delta X_1$ $$\Delta X_1=ABS[(g.V_s.\Delta V_{(1,1\&2)})/\{V.(V+\Delta V_{(1,1\&2)})\}]$$

(9) $\Delta X_2$ $$\Delta X_2=ABS[(g.V_s.\ \Delta V_{(2,1\&2)})/\{V.(V+\Delta V_{(2,1\&2)})\}]$$

(10) $F(\delta)$ $$F(\delta)=(w_1.\Delta X_1+w_2.\Delta X_2)/2,$$

Where w=1 if $\Delta X$=/<e, and w=k if $\Delta X$>e $F(\delta_1)$ may be shown graphically as a function of $\delta_1$ and optimum values of $\delta_1$ chosen from where $F(\delta_1)$ is small. By definition, $\delta_1$ is negative but if positive values of $\delta$ are included, it is seen that $F(\delta)$ is symmetrical about $\delta$=0.

2 Phase (High Frequency)

To calculate the delays, the following experimental data is needed: The same data as for low frequency case plus:

$V_{(1,1)(f)}$—i.e., the velocity of the same "receiver" phase 1 channel with just all phase 1 channels firing measured as a function of frequency over the desired frequency range.

Calculation of $F(\delta_1, f)$ From Input Data:

Input data is:

$V_{(1,1\ \&\ 2)(0)}(\delta)$, V {equivalent to $\Delta V_{(1,1\ \&\ 2)(0)}(\delta)$}

$V_{(1,1)(f)}$

Paper gap, g (default 60 mils)

Paper speed, Vs (default 2 M/sec)

Max. dot error, e (default 1 mil)

Linear weighting value, k (default 2)

If f is sufficiently low, the previous low frequency, 2 phase calculation can be used. To determine whether f is sufficiently low, first find the highest value of $\delta_1$, say $\delta_h$, below which there are no changes in $V_{(1,1\ \&\ 2)}$—according to testing data, $\delta_h$ was about (−300)$\mu$sec. The frequency is sufficiently low if:

$$f<1/(\delta_h+\delta_{max})$$

In general, to calculate F at any frequency, compute $\Delta V_{(1,1\&2)(f)}(\delta)$ and $\Delta V_{(2,1\&2)(f)}(\delta)$. The low frequency calculation must be modified to include the contributions from previous firings.

(1) $\Delta V_{(1,2)(0)}(\delta)$ is calculated as described for the low frequency case.

Then:

(2) $\Delta V_{(1,2)(f)}(\delta)$, where:

$$\Delta V_{(1,2)(f)}(\delta)=\Delta V_{(1,2)(0)}(\delta)+[\Delta V_{(1,2)(0)}(\delta-1/f)+\Delta V_{(1,2)(0)}(\delta+1/f)]+[\Delta V_{(1,2)(0)}(\delta-2/f)+\Delta V_{(1,2)(0)}(\delta+2/f)]+[\Delta V_{(1,2)(0)}(\delta-3/f)+\Delta V_{(1,2)(0)}(\delta+3/f)]+\ .\ .\ .\ +[\Delta V_{(1,2)(0)}(\delta-(n-1)/f)+\Delta V_{(1,2)(0)}(\delta+(n-1)/f)]$$

This calculation may be carried out to n terms. n may be chosen to be the maximum value at which any contributions from higher terms would be zero. For example, the (n+1)th term is:

$$[\Delta V_{(1,2)(0)}(\delta-n/f)+\Delta V_{(1,2)(0)}(\delta+n/f)]$$

This is zero if:

$(\delta-n/f)<\delta_h$ or >25 $\mu$sec, and $(\delta+n/f)<\delta_h$ or >25 $\mu$sec n is thus chosen so that this condition is satisfied for the highest frequency in the range. The condition will then be satisfied also for all lower frequencies. In some cases, lower order terms in the series may give a zero contribution but contributions may then occur in higher order terms up to the nth term. The calculation of $\Delta V_{(1,2)(f)}(\delta)$ is repeated for a number of values of f.

(3) $\Delta V_{(1,1\&2)(f)}(\delta)$ $\Delta V_{(1,1\&2)(f)}(\delta)$ can then be calculated from:

$$\Delta V_{(1,1\&2)(f)}(\delta)=\Delta V_{(1,2)(f)}(\delta)+\Delta V_{(1,1)(f)}$$

$\Delta V_{(1,1)(f)}$ is the additional experimental data needed for the high frequency case.

(4) $\Delta V_{(2,1\&2)(f)}(\delta)$ $$\Delta V_{(2,1\&2)(f)}(\delta)=\Delta V_{(2,1)(f)}(\delta)+\Delta V_{(2,2)(f)}$$

The same logic as was used for f=0 is still valid at any f:

(5) $\Delta V_{(2,2)(f)}$ $\Delta V_{(2,2)(f)}=\Delta V_{(1,1)(f)}$, and:

(6) $\Delta V_{(2,1)(f)}(\delta)$ $\Delta V_{(2,2)(f)}(\delta)=\Delta V_{(1,2)(f)}(-\delta)$, thus:

(7) $\Delta V_{(2,1\&2)(f)}(\delta)$ $$\Delta V_{(2,1\&2)(f)}(\delta)=\Delta V(1,2)(f)(-\delta)+\Delta V_{(1,1)(f)}$$

(8) $\Delta X_1(\delta_1,f)$ and $\Delta X_2(\delta_1,f)$ $\Delta X_1(\delta_1,f)$ and $\Delta X_2(\delta_1,f)$ are calculated in the same way as for f=0 but the calculation is now repeated for a number of values of f.

(9) $F(\delta_1,f)$ $F(\delta_1,f)$ is now calculated in the same way as for f=0 but is now also a function of f. The idea is to either display F in a number of superimposed 2-dimensional plots or to display F as a 3 dimensional surface. Also a 2-dimensional display that would help to select an optimum $\delta_1$ for the whole operating range of frequencies is to display F vs. $\delta_1$ and for each point display the highest (worst case) value of F at any frequency.

In all cases, it may be of more practical value to limit the frequencies to just discrete values that can occur in a printer. For example if the maximum possible firing rate is at flax then the series of discrete frequencies possible is:

$$f_{max}, f_{max}/2, f_{max}/3, \ldots f_{max}/n$$

In a similar way, $F(\delta_1,f)$ could also have been calculated using for the experimental frequency data $V_{(1,1\&2)(f)}$ instead of $V_{(1,1)(f)}$. This can be seen from equation (3) above:

$$\Delta V_{(1,1\&2)(f)}(\delta)=\Delta V_{(1,2)(f)}(\delta)+\Delta V_{(1,1)(f)}$$

It is shown above that the term $\Delta V_{(1,2)(f)}(\delta)$ can be calculated from the low frequency data $\Delta V_{(1,2)(0)}(\delta)$. Thus, if either of the terms $\Delta V_{(1,1)(f)}$ or $\Delta V_{(1,1\&2)(f)}(\delta)$ is known experimentally, the other can be calculated. It would only be necessary to measure $\Delta V_{(1,1\&2)(f)}(\delta)$ at one value of δ–one of the values included in the data $\Delta V_{(1,2)(f)}(\delta)$. Similar reasoning applies in the general case for N-phase firing. The advantage experimentally of using $V_{(1,1\&2)(f)}$–(cross-talk versus frequency with all channels firing) is that just a single set of measurements would suffice for any number of phases. Whereas if V(l,l)(f) is used, then a different set of data is needed for each case when the number of phases is changed. A disadvantage of using $V_{(1,1\&2)(f)}$ may be that any errors due to departures from the linear additive assumption may be exacerbated.

3 Phase (Low Frequency)—Unequal Delays

The phases may be arranged 1,2,3,1,2,3 . . . . The delay, $\delta_1$, between phase 1 (first to fire) and phase 2 is δ and the delay, $\delta_2$, between phase 2 and phase 3 is $M_1\delta_1$. In the 3-phase case, it is possible, because of symmetry to define phase 2 as the second phase to fire. Thus both $\delta_1$ and $\delta_2$ are negative and therefore $M_1$ is always positive. Practical values of $(\delta_1+\delta_2)$ may be from 0 to −½f. If the smallest non-zero absolute value of $\delta_1$ is 1 μsec, the practical values of $M_1$ may range from 1 to 1000/2f where f is in kHz.

The following experimental data is needed:

(1) Using a phase 1 channel near the middle of the print head, measure velocity, V, firing alone.

(2) Measure the velocity $V_{(1,1\ \&\ 2)}(\delta)$–all phase 1 and phase 2 channels firing. Measure over a range of δ from +20 to −300 μsec.

The calculation of $F(\delta_1, M_1)$ from input data:

The input data is:

$V_{(1,1\ \&\ 2)}(\delta)$ and V {equivalent to $\Delta V_{(1,1\ \&\ 2)}(\delta)$}
Paper gap, g (default 60 mils)
Paper speed, $V_s$ (default 2 M/sec)
Max. dot error, e (default 1 mil)
Linear weighting value, k (default 2)
Phase (2–3) delay multiplier, $M_1$ Phase 1 calculations to compute $\Delta V_{(1,1\ \&\ 2\&3)}$:

(1) $\Delta V_{(1,1\ \&\ 2)}=V_{(1,1\ \&\ 2)}-V$
(2) $\Delta V_{(1,1)}=\Delta V_{(1,1\ \&\ 2)}(\delta=20)$
(3) $\Delta V_{(1,1\ \&\ 3)}=\Delta V_{(1,1\ \&\ 2)}(\{1+M_1\}\delta)$
(4) $\Delta V_{(1,1\ \&\ 2\&3)}=\Delta V_{(1,1\ \&\ 2)}+\Delta V_{(1,1\ \&\ 3)}-\Delta V_{(1,1)}$ Phase 2 calculations to compute $\Delta V_{(2,1\ \&\ 2\&3)}$:

(5) $\Delta V_{(2,2)}=\Delta V_{(1,1)}$
(6) $\Delta V_{(2,2\ \&\ 3)}=\Delta V_{(1,1\ \&\ 2)}(\{M_1\delta)$
(7) $\Delta V_{(2,2\ \&\ 1)}=\Delta V_{(1,1\ \&\ 2)}(-\delta)$
(8) $\Delta V_{(2,1\ \&\ 2\&3)}=\Delta V_{(2,2\ \&\ 3)}+\Delta V_{(2,2\ \&\ 1)}-\Delta V_{(2,2)}$ Phase 3 calculations to compute $\Delta V_{(3,1\ \&\ 2\&3)}$:

(9) $\Delta V_{(3,3)}=\Delta V_{(1,1)}$
(10) $\Delta V_{(3,3\ \&\ 2)}=\Delta V_{(1,1\ \&\ 2)}(\{-M_1\delta)$
(11) $\Delta V_{(3,3\ \&\ 1)}=\Delta V_{(1,1\ \&\ 2)}(-\{1+M_1\}\delta)$
(12) $\Delta V_{(3,1\ \&\ 2\&3)}=\Delta V_{(3,3\ \&\ 2)}+\Delta V_{(3,3\ \&\ 1)}-\Delta V_{(3,3)}$ Using $\Delta X=ABS\ [(g.V_s.\Delta V)/\{V.(V+\Delta V)\}]$, then compute:

(13) $\Delta X_1$ for $\Delta V_{(1,1\ \&\ 2\&3)}$
(14) $\Delta X_2$ for $\Delta V_{(2,1\ \&\ 2\&3)}$
(15) $\Delta X_3$ for $\Delta V_{(3,1\ \&\ 2\&3)}$ Then compute F:

(16) $F=(w_1.\Delta X_1+w_2.\Delta X_2+w_3.\Delta X_3)/3$
If $\Delta X=/<e$, w=1
If $\Delta X>e$, w=k $F(\delta_1, M_1)$ is thus determined. This can either be displayed as a 3-dimensional surface or as a number of superimposed 2-dimensional plots of F vs. as with the parameter $M_1$ being changed for each plot.

3 Phase (High Frequency)—Unequal Delays

The phases and delays are the same as for the 3 phase low frequency case.

The following experimental data is needed:

Same as for low frequency case plus:

$V_{(1,1)(f)}$—i.e. the velocity of the same "receiver" phase 1 channel with just all phase 1 channels firing measured as a function of frequency over the desired frequency range. Calculation of $F(\delta_1, M_1, f)$ from input data:

Input data is:

$V_{(1,1\ \&\ 2)(0)}(\delta)$, V {equivalent to $\Delta V_{(1,1\ \&\ 2)(0)}(\delta)$}
$V_{(1,1)(f)}$
Paper gap, g (default 60 mils)
Paper speed, $V_s$ (default 2 M/sec)
Max. dot error, e (default 1 mil)
Linear weighting value, k (default 2)
Phase (2–3) delay multiplier, M (M=M1 but is not restricted to practical range of M1 . . . M is limited only by the consideration that the delay remains between 25 and −300 μsec).

If f is sufficiently low, the previous low frequency, 3-phase calculation can be used. To determine whether f is sufficiently low, first find the highest absolute value of δ, e.g., $\delta_h$, below which there are no changes in $V_{(1,1\ \&\ 2\ \&\ 3)}$ or $V_{(2,1\ \&\ 2\ \&\ 3)}$ or $V_{(3,1\ \&\ 2\ \&\ 3)}$. The frequency is sufficiently low if:

$$f<1/(\delta_h+\delta_{max})$$

In general, to calculate F at any frequency, we first have to compute $\Delta V_{(1,1\&2\&3)(f)}(\delta)$, $\Delta V_{(2,1\&2\&3)(f)}(\delta)$, and $\Delta V_{(3,1\&2\&3)(f)}(\delta)$, The low frequency calculation must be modified to include the contributions from previous firings.

(1) For the low frequency case, $\Delta V_{(1,1\ \&\ 2\&3)(0)}$ was calculated from:
$\Delta V_{(1,1\ \&\ 2\&3)(0)}=\Delta V_{(1,1\ \&\ 2)(0)}+\Delta V_{(1,1\ \&\ )(0)}-\Delta V_{(1,1)(0)}$
or:
$\Delta V_{(1,1\ \&\ 2\&3)(0)}=\Delta V_{(1,2)(0)}+\Delta V_{(1,\ 3)(0)}+\Delta V_{(1,1)(0)}$ At any frequency, f:
$\Delta V_{(1,1\ \&\ 2\&3)(f)}=\Delta V_{(1,\ 2)(f)}+\Delta V_{(1,\ 3)(f)}+\Delta V_{(1,1)(f)}$ $\Delta V_{(1,1)(f)}$ is obtained directly from the input data:
$\Delta V_{(1,1)(f)}=V_{(1,1)(f)}-V$ and the other 2 terms, $\Delta V_{(1,2)(f)}, \Delta V_{(1,3)(f)}$ can be obtained from the low frequency data as follows:

$$\Delta V_{(1,2)(f)}(\delta)=\Delta V_{(1,2)(0)}(\delta)+[\Delta V_{(1,2)(0)}(\delta-1/f)+\Delta V_{(1,2)(0)}(\delta+1/f)]+[\Delta V_{(1,2)(0)}(\delta-2/f)+\Delta V_{(1,2)(0)}(\delta+2/f)]+[\Delta V_{(1,2)(0)}(\delta-3/f)+\Delta V_{(1,2)(0)}(\delta+3/f)]+\ldots+[\Delta V_{(1,2)(0)}(\delta-(n-1)/f)+\Delta V_{(1,2)(0)}(\delta+(n-1)/f)]$$

$$\Delta V_{(1,3)(f)}(\delta)=\Delta V_{(1,3)(0)}(\delta)+[\Delta V_{(1,3)(0)}(\delta-1/f)+\Delta V_{(1,3)(0)}(\delta+1/f)]+[\Delta V_{(1,3)(0)}(\delta-2/f)+\Delta V_{(1,3)(0)}(\delta+2/f)]+[\Delta V_{(1,3)(0)}(\delta-3/f)+\Delta V_{(1,3)(0)}(\delta+3/f)]+\ldots+[\Delta V_{(1,3)(0)}(\delta-(n-1)/f)+\Delta V_{(1,3)(0)}(\delta+(n-1)/f)]$$

These equations for $\Delta V_{(1,2)(f)}(\delta)$ and $\Delta V_{(1,3)(f)}(\delta)$ are needed for computing the phase 1 ΔVs. For phases 2 and 3, the following are also needed: $\Delta V_{(2,1)(f)}(\delta)$, $\Delta V_{(2,3)(f)}(\delta)$, $\Delta V_{(3,1)(f)}(\delta)$ and $\Delta V_{(3,2)(f)}(\delta)$. These equations are identical to the above with the appropriate suffices substituted:

$$\Delta V_{(a,b)(f)}(\delta)=\Delta V_{(a,b)(0)}(\delta)+[\Delta V_{(a,b)(0)}(\delta-1/f)+\Delta V_{(a,b)(0)}(\delta+1/f)]+[\Delta V_{(a,b)(0)}(\delta-2/f)+\Delta V_{(a,b)(0)}(\delta+2/f)]+[\Delta V_{(a,b)(0)}(\delta-3/f)+\Delta V_{(a,b)(0)}(\delta+3/f)]+\ldots+[\Delta V_{(a,b)(0)}(\delta-(n-1)/f)+\Delta V_{(a,b)(0)}(\delta+(n-1)/f)]$$

This calculation is carried out to n-terms (e.g., see 2-Phase, High Frequency discussion above) and is repeated for a number of values of f. The low frequency terms, $\Delta V_{(1,2)(0)}(\delta)$, $\Delta V_{(1,3)(0)}(\delta)$, $\Delta V_{(2,1)(0)}(\delta)$, $\Delta V_{(2,2)(0)}(\delta)$, $\Delta V_{(3,1)(0)}(\delta)$ and $\Delta V_{(3,2)(0)}(\delta)$, are calculated from the experimental data, $V_{(1,1\&2)(0)}(\delta)$:

$\Delta V_{(1,2)(0)}(\delta)$:

$$\Delta V_{(1,2)(0)}(\delta)=\Delta V_{(1,1\&2)(0)}(\delta)-\Delta V_{(1,1)(0)}$$

or, completely in terms of the experimental data:

$$\Delta V_{(1,2)(0)}(\delta)=V_{(1,1\&2)(0)}(\delta)-V_{(1,1\&2)(0)}(\delta=20)$$

$\Delta V_{(1,3)(0)}(\delta, M)$:

$$\Delta V_{(1,3)(0)}(\delta,M)=V(1,1\ \&\ 2)(0)(\{1+M\}\delta)-V_{(1,1\&2)(0)}(\delta 6=20)=\Delta V_{(1,2)(0)}(\{1+M\}\delta)$$

$\Delta V_{(2,1)(0)}(\delta, )$:

$$\Delta V_{(2,1)(0)}(\delta)=V_{(1,1\&2)(0)}(-\delta)-V_{(1,1\&2)(0)}(\delta=20)=\Delta V_{(1,2)(0)}(-\delta)$$

$\Delta V_{(2,3)(0)}(\delta, M)$:

$$\Delta V_{(2,3)(0)}(\delta,M)=V_{(1,1\ \&\ 2)(0)}(M\delta)-V_{(1,1\&2)(0)}(\delta=20)=\Delta V_{(1,2)(0)}(M\delta)$$

$\Delta V_{(3,1)(0)}(\delta, M)$:

$$\Delta V_{(3,1)(0)}(\delta,M)=V_{(1,1\ \&2)(0)}(-\{1+M\}\delta)-V_{(1,1\&2)(0)}(\delta=20)=\Delta V_{(1,2)(0)}(-\{1+M\}\delta)$$

$\Delta V_{(3,2)(0)}(\delta, M)$:

$$\Delta V_{(3,2)(0)}(\delta,M)=V_{(1,1\ \&\ 2)(0)}(-M\delta)-V_{(1,1\&2)(0)}(\delta=20)=\Delta V_{(1,2)(0)}(-M\delta)$$

The two "V" terms on the right side of the above equations could also have been written as ΔVs, e.g.:

$$\Delta V_{(1,3)(0)}(\delta,M)=V_{(1,1\ \&2)(0)}(\{1+M\}\delta)-V_{(1,1\ \&2)(0)}(\delta=20),\text{ and }\Delta V_{(1,1\&2)(0)}(\delta=20)=\Delta V_{(1,1)(0)}$$

Therefore, in terms of the ΔVs expressed above:

$\Delta V_{(1,1\&2\&3)(f)}(\delta, M)$:

$$\Delta V_{(1,1\&2\&3)(f)}(\delta,M)=\Delta V_{(1,1)(f)}+\Delta V_{(1,2)(0)}(\delta)+[\Delta V_{(1,2)(0)}((\delta)-1/f)+\Delta V_{(1,2)(0)}((\delta)+1/f)]+[\Delta V_{(1,2)(0)}((\delta)-2/f)+\Delta V_{(1,2)(0)}((\delta)+2/f)]+[\Delta V_{(1,2)(0)}((\delta)-3/f)+\Delta V_{(1,2)(0)}((\delta)+3/f)]+\ldots+[\Delta V_{(1,2)(0)}((\delta)-(n-1)/f)+\Delta V_{(1,2)(0)}((\delta)+(n-1)/f)]+\Delta V_{(1,3)(0)}(\delta)+[\Delta V_{(1,3)(0)}((\delta)-1/f)+\Delta V_{(1,3)(0)}((\delta)+1/f)]+[\Delta V_{(1,3)(0)}((\delta)-2/f)+\Delta V_{(1,3)(0)}((\delta)+2/f)]+[\Delta V_{(1,3)(0)}((\delta)-3/f)+\Delta V_{(1,3)(0)}((\delta)+3/f)]+\ldots+[\Delta V_{(1,3)(0)}((\delta)-(n-1)/f)+\Delta V_{(1,3)(0)}((\delta)+(n-1)/f)]$$

Similar equations can be obtained for the ΔVs for phases 2 and 3:

$\Delta V_{(2,1\&2\&3)(f)}(\delta, M)$:

$$\Delta V_{(2,1\&2\&3)(f)}(\delta,M)=\Delta V_{(1,1)(f)}+\Delta V_{(2,1)(0)}(\delta)+[\Delta V_{(2,1)(0)}((\delta)-1/f)+\Delta V_{(2,1)(0)}((\delta)+1/f)]+[\Delta V_{(2,1)(0)}((\delta)-2/f)+\Delta V_{(2,1)(0)}((\delta)+2/f)]+[\Delta V_{(2,1)(0)}((\delta)-3/f)+\Delta V_{(2,1)(0)}((\delta)+3/f)]+\ldots+[\Delta V_{(2,1)(0)}((\delta)-(n-1)/f)+\Delta V_{(2,1)(0)}((\delta)+(n-1)/f)]+\Delta V_{(2,3)(0)}(\delta)+[\Delta V_{(2,3)(0)}((\delta)-1/f)+\Delta V_{(2,3)(0)}((\delta)+1/f)]+[\Delta V_{(2,3)(0)}((\delta)-2/f)+\Delta V_{(2,3)(0)}((\delta)+2/f)]+[\Delta V_{(2,3)(0)}((\delta)-3/f)+\Delta V_{(2,3)(0)}((\delta)+3/f)]+\ldots+[\Delta V_{(2,3)(0)}((\delta)-(n-1)/f)+\Delta V_{(2,3)(0)}((\delta)+(n-1)/f)]$$

$\Delta V_{(3,1\&2\&3)(f)}(\delta, M)$:

$$\Delta V_{(3,1\&2\&3)(f)}(\delta,M)=\Delta V_{(1,1)(f)}+\Delta V_{(3,1)(0)}(\delta)+[\Delta V_{(3,1)(0)}((\delta)-1/f)+\Delta V_{(3,1)(0)}((\delta)+1/f)]+[\Delta V_{(3,1)(0)}((\delta)-2/f)+\Delta V_{(3,1)(0)}((\delta)+2/f)]+[\Delta V_{(3,1)(0)}((\delta)-3/f)+\Delta V_{(3,1)(0)}((\delta)+3/f)]+\ldots+[\Delta V_{(3,1)(0)}((\delta)-(n-1)/f)+\Delta V_{(3,1)(0)}((\delta)+(n-1)/f)]+\Delta V_{(3,2)(0)}(\delta)+[\Delta V_{(3,2)(0)}((\delta)-1/f)+\Delta V_{(3,2)(0)}((\delta)+1/f)]+[\Delta V_{(3,2)(0)}((\delta)-2/f)+\Delta V_{(3,2)(0)}((\delta)+2/f)]+[\Delta V_{(3,2)(0)}((\delta)-3/f)+\Delta V_{(3,2)(0)}((\delta)+3/f)]+\ldots+[\Delta V_{(3,2)(0)}((\delta)-(n-1)/f)+\Delta V_{(3,2)(0)}((\delta)+(n-1)/f)]$$

When calculating the three ΔV terms in the above equations, it is necessary to use the expressions for $\Delta V_{(1,3)(0)}(\delta,M)$, $\Delta V_{(2,3)(0)}(\delta,M)$, $\Delta V_{(3,1)(0)}(\delta,M)$ and $\Delta V_{(3,2)(0)}(\delta,M)$. These expressions contain an argument which is M, −M, (1+M) or −(1+M) multiplied by δ. When substituting into the terms in the above frequency series which have arguments of the form ((δ)+/−p/f), it is only the (δ) term in the argument that is multiplied by M, −M, (1+M) or −(1+M).

For example, using:

$\Delta V_{(1,3)(0)}(\delta,M)=\Delta V_{(1,2)(0)}(\{1+M\}\delta$, the following is obtained:

$$\Delta V_{(1,3)(0)}(\delta 1/f)=\Delta V_{(1,2)(0)}(\{1+M\}\delta-1/f)$$

Thus, writing out the expression for $\Delta V_{(1,1\&2\&3)(f)}(\delta,M)$ in fill, it becomes:

$$\Delta V_{(1,1\&2\&3)(f)}(\delta,M)=\Delta V_{(1,1)(f)}+\Delta V_{(1,2)(0)}(\delta)+$$
$$[\Delta V_{(1,2)(0)}((\delta)-1/f)+\Delta V_{(1,2)(0)}((\delta)+1/f)]+$$
$$[\Delta V_{(1,2)(0)}((\delta)-2/f)+\Delta V_{(1,2)(0)}((\delta)+2/f)]+$$
$$[\Delta V_{(1,2)(0)}((\delta)-3/f)+\Delta V_{(1,2)(0)}((\delta)+3/f)]+\ldots+$$
$$[\Delta V_{(1,2)(0)}((\delta)-(n-1)/f)+\Delta V_{(1,2)(0)}((\delta)+(n-1)/f)]+$$
$$\Delta V_{(1,2)(0)}(\{1+M\}(\delta)+[\Delta V_{(1,2)(0)}(\{1+M\}(\delta)-(1/f))+$$
$$\Delta V_{(1,2)(0)}(\{1+M\}(\delta)+(1/f))]+[\Delta V_{(1,2)(0)}(\{1+M\}(\delta)-$$
$$(2/f))+\Delta V_{(1,2)(0)}(\{1+M\}(\delta)+(2/f)]+$$
$$[\Delta V_{(1,2)(0)}(\{1+M\}(\delta)-(3/f)+\Delta V_{(1,2)(0)}(\{1+M\}(\delta)+$$
$$(3/f))]+\ldots[\Delta V_{(1,2)(0)}(\{1+M\}(\delta)-((n-1)/f))+$$
$$\Delta V_{(1,2)(0)}(\{1+M\}(\delta)+((n-1)/f))]$$

Using the above equations for $\Delta V_1$, $\Delta V_2$ and $\Delta V_3$, the ΔXs can be computed using:

$\Delta X=ABS[(g.V_s.\Delta V)/\{V.(V+\Delta V)\}]$, to obtain:

$\Delta X_1$ for $\Delta V_{(1,1\&2\&3)(f)}(\delta_1, M_1)$
$\Delta X_2$ for $\Delta V_{(2,1\&2\&3)(f)}(\delta_1, M_1)$
$\Delta X_3$ for $\Delta V_{(3,1\&2\&3)(f)}(\delta_1, M_1)$ Now, F can be computed:

$$F(\delta_1, M_1, f)=(w_1.\Delta X_1+w_2.\Delta X_2+w_3.\Delta X_3)/3$$

If ΔX=/<e, w=1

If ΔX>e, w=k

This is a 4-dimensional function for which to determine regions of low values for F. One possibility may be to display $F(\delta_1, M_1)$ as a series of 3 dimensional surfaces for a series of values of f.

4 Phase (High Frequency)–Unequal Delays

The phases may be arranged 1,2,3,4,1,2,3,4 . . . . The delay between phase 1 (first to fire) and phase 2 is $\delta_1$, the delay, $\delta_2$, between phase 2 and phase 3 is $M_1\delta_1$ and the delay $\delta_3$, between phase 3 and phase 4 is $M'_1\delta_1$.

With 2- and 3-phase firing it was possible to calculate the cross-talk, ΔV, for all possible combinations of phases firing from just one set of experimental data. The set chosen was $V_{(1,1\ \&\ 2)(0)}(\delta, M)$ and V. Using the basic assumptions and symmetries between the phases, it was possible to calculate ΔV for all phases at low frequency. It was also possible to calculate all of the high frequency sets except for $\Delta V_{(1,1)(f)}$, $\Delta V_{(2,2)(f)}$ and $\Delta V_{(3,3)(f)}$. Since $\Delta V_{(1,1)(f)}=\Delta V_{(2,2)(f)}=\Delta V_{(3,3)(f)}$, it was necessary only to measure one set for the high frequency calculations. The set used in the calculations was $\Delta V_{(1,1)(f)}$ but as explained above with respect to the 2-phase high frequency cases, another possibility would be $\Delta V_{(1,1\&2\&3)(f)}$ at one value of δ.

For 4-phase firing, one additional set of experimental data is needed for the low frequency calculations. Several possibilities exist for the two sets of experimental data needed. The two sets chosen are $V_{(1,1\ \&\ 2)(0)}(\delta)$, $V_{(1,1\ \&\ 3)(0)}(\delta)$ and V. Also, as was the case for 2 and 3 phases, just one set of data is needed for the high frequency calculations. Again, the set chosen is for the calculation is $\Delta V_{(1,1)(f)}$, but an alternative could still be $\Delta V_{(1,1\&2\&3\&4)(f)}$, Calculation of $F(\delta_1, M_1, M'_1, f)$ from input data:

Input data is:

$V_{(1,1\ \&\ 2)(0)}(\delta)$, $V_{(1,1\ \&3)(0)}(\delta)$, V and $V_{(1,1)(f)}$
Paper gap, g (default 60 mils)
Paper speed, $V_s$ (default 2 M/sec)
Max. dot error, e (default 1 mil)
Linear weighting value, k (default 2)
Phase (2–3) delay multiplier, $M_1$
Phase (3–4) delay multiplier, $M'_1$ The calculation is very similar to the 3 phase case:

General Expressions for ΔVs at High Frequency $\Delta V_{(1,1\&2\&3\&4)(f)}(\delta, M, M')$:

$$\Delta V_{(1,1\&2\&3\&4)(f)}(\delta,M,M')=\Delta V_{(1,1)(f)}+\Delta V_{(1,2)(0)}(\delta)+$$
$$[\Delta V_{(1,2)(0)}((\delta)-1/f)+\Delta V_{(1,2)(0)}((\delta)+1/f)]+$$
$$[\Delta V_{(1,2)(0)}((\delta)-2/f)+\Delta V_{(1,2)(0)}((\delta)+2/f)]+$$
$$[\Delta V_{(1,2)(0)}((\delta)-3/f)+\Delta V_{(1,2)(0)}((\delta)+3/f)]+\ldots+$$
$$[\Delta V_{(1,2)(0)}((\delta)-(n-1)/f)+\Delta V_{(1,2)(0)}((\delta)+$$
$$(n-1)/f)]+\Delta V_{(1,3)(0)}(\delta)+[\Delta V_{(1,3)(0)}((\delta)-1/f)+$$
$$\Delta V_{(1,3)(0)}((\delta)+1/f)]+[\Delta V_{(1,3)(0)}((\delta)-2/f)+$$
$$\Delta V_{(1,3)(0)}((\delta)+2/f)]+[\Delta V_{(1,3)(0)}((\delta)-3/f)+$$
$$\Delta V_{(1,3)(0)}((\delta)+3/f)]+\ldots+[\Delta V_{(1,3)(0)}((\delta)-(n-1)/$$
$$f)+\Delta V_{(1,3)(0)}((\delta)+(n-1)/f)]+\Delta V_{(1,4)(0)}(\delta)+$$
$$[\Delta V_{(1,4)(0)}((\delta)-1/f)+\Delta V_{(1,4)(0)}((\delta)+1/f)]+$$
$$[\Delta V_{(1,4)(0)}((\delta)-2/f)+\Delta V_{(1,4)(0)}((\delta)+2/f)]+$$
$$[\Delta V_{(1,4)(0)}((\delta)-3/f)+\Delta V_{(1,4)(0)}((\delta)+3/f)]+\ldots+$$
$$[\Delta V_{(1,4)(0)}((\delta)-(n-1)/f)+\Delta V_{(1,4)(0)}((\delta)+(n-1)/f)]$$

$\Delta V_{(2,1\&2\&3)(f)}(\delta, M, M')$ $$\Delta V_{(2,1\&2\&3\&4)(f)}(\delta,M,M')=\Delta V_{(1,1)(f)}+\Delta V_{(2,1)(0)}(\delta)+$$
$$[\Delta V_{(2,1)(0)}((\delta)-1/f)+\Delta V_{(2,1)(0)}((\delta)+1/f)]+$$
$$[\Delta V_{(2,1)(0)}((\delta)-2/f)+\Delta V_{(2,1)(0)}((\delta)+2/f)]+$$
$$[\Delta V_{(2,1)(0)}((\delta)-3/f)+\Delta V_{(2,1)(0)}((\delta)+3/f)]+\ldots+$$
$$[\Delta V_{(2,1)(0)}((\delta)-(n-1)/f)+\Delta V_{(2,1)(0)}((\delta)+$$
$$(n-1)/f)]+\Delta V_{(2,3)(0)}(\delta)+[\Delta V_{(2,3)(0)}((\delta)-1/f)+$$
$$\Delta V_{(2,3)(0)}((\delta)+1/f)]+[\Delta V_{(2,3)(0)}((\delta)-2/f)+$$
$$\Delta V_{(2,3)(0)}((\delta)+2/f)]+[\Delta V_{(2,3)(0)}((\delta)-3/f)+$$

$$\Delta V_{(2,3)(0)}((\delta)+3/f)]+\ldots+[\Delta V_{(2,3)(0)}((\delta)-(n-1)/f)+\Delta V_{(2,3)(0)}((\delta)+(n-1)/f)]+\Delta V_{(2,4)(0)}(\delta)+[\Delta V_{(2,4)(0)}((\delta)-1/f)+\Delta V_{(2,4)(0)}((\delta)+1/f)]+[\Delta V_{(2,4)(0)}((\delta)-2/f)+\Delta V_{(2,4)(0)}((\delta)+2/f)]+[\Delta V_{(2,4)(0)}((\delta)-3/f)+\Delta V_{(2,4)(0)}((\delta)+3/f)]+\ldots+[\Delta V_{(2,4)(0)}((\delta)-(n-1)/f)+\Delta V_{(2,4)(0)}((\delta)+(n-1)/f)]$$

$\Delta V_{(3,1\&2\&3\&4)(f)}(\delta, M, M')$:

$$\Delta V_{(3,1\&2\&3\&4)(f)}(\delta,M,M')=\Delta V_{(1,1)(f)}+\Delta V_{(3,1)(0)}(\delta)+[\Delta V_{(3,1)(0)}((\delta)-1/f)+\Delta V_{(3,1)(0)}((\delta)+1/f)]+[\Delta V_{(3,1)(0)}((\delta)-2/f)+\Delta V_{(3,1)(0)}((\delta)+2/f)]+[\Delta V_{(3,1)(0)}((\delta)-3/f)+\Delta V_{(3,1)(0)}((\delta)+3/f)]+\ldots+[\Delta V_{(3,1)(0)}((\delta)-(n-1)/f)+\Delta V_{(3,1)(0)}((\delta)+(n-1)/f)]+\Delta V_{(3,2)(0)}(\delta)+[\Delta V_{(3,2)(0)}((\delta)-1/f)+\Delta V_{(3,2)(0)}((\delta)+1/f)]+[\Delta V_{(3,2)(0)}((\delta)-2/f)+\Delta V_{(3,2)(0)}((\delta)+2/f)]+[\Delta V_{(3,2)(0)}((\delta)-3/f)+\Delta V_{(3,2)(0)}((\delta)+3/f)]+\ldots+[\Delta V_{(3,2)(0)}((\delta)-(n-1)/f)+\Delta V_{(3,2)(0)}((\delta)+(n-1)/f)]+\Delta V_{(3,4)(0)}(\delta)+[\Delta V_{(3,4)(0)}((\delta)-1/f)+\Delta V_{(3,4)(0)}((\delta)+1/f)]+[\Delta V_{(3,4)(0)}((\delta)-2/f)+\Delta V_{(3,4)(0)}((\delta)+2/f)]+[\Delta V_{(3,4)(0)}((\delta)-3/f)+\Delta V_{(3,4)(0)}((\delta)+3/f)]+\ldots+[\Delta V_{(3,4)(0)}((\delta)-(n-1)/f)+\Delta V_{(3,4)(0)}((\delta)+(n-1)/f)]$$

$\Delta V_{(4,1\&2\&3\&4)(f)}(\delta, M, M')$:

$$\Delta V_{(4,1\&2\&3\&4)(f)}(\delta,M,M')=\Delta V_{(1,1)(f)}+\Delta V_{(4,1)(0)}(\delta)+[\Delta V_{(4,1)(0)}((\delta)-1/f)+\Delta V_{(4,1)(0)}((\delta)+1/f)]+[\Delta V_{(4,1)(0)}((\delta)-2/f)+\Delta V_{(4,1)(0)}((\delta)+2/f)]+[\Delta V_{(4,1)(0)}((\delta)-3/f)+\Delta V_{(4,1)(0)}((\delta)+3/f)]+\ldots+[\Delta V_{(4,1)(0)}((\delta)-(n-1)/f)+\Delta V_{(4,1)(0)}((\delta)+(n-1)/f)]+\Delta V_{(4,2)(0)}(\delta)+[\Delta V_{(4,2)(0)}((\delta)-1/f)+\Delta V_{(4,2)(0)}((\delta)+1/f)]+[\Delta V_{(4,2)(0)}((\delta)-2/f)+\Delta V_{(4,2)(0)}((\delta)+2/f)]+[\Delta V_{(4,2)(0)}((\delta)-3/f)+\Delta V_{(4,2)(0)}((\delta)+3/f)]+\ldots+[\Delta V_{(4,2)(0)}((\delta)-(n-1)/f)+\Delta V_{(4,2)(0)}((\delta)+(n-1)/f)]+\Delta V_{(4,3)(0)}(\delta)+[\Delta V_{(4,3)(0)}((\delta)-1/f)+\Delta V_{(4,3)(0)}((\delta)+1/f)]+[\Delta V_{(4,3)(0)}((\delta)-2/f)+\Delta V_{(4,3)(0)}((\delta)+2/f)]+[\Delta V_{(4,3)(0)}((\delta)-3/f)+\Delta V_{(4,3)(0)}((\delta)+3/f)]+\ldots+[\Delta V_{(4,3)(0)}((\delta)-(n-1)/f)+\Delta V_{(4,3)(0)}((\delta)+(n-1)/f)]$$

General Expressions for $\Delta V_{(a,b)(0)}$s in Terms of Experimental Data

The following low frequency data sets are calculated for use in the above equations:

$\Delta V_{(1,2)(0)}(\delta)$:

$$\Delta V_{(1,2)(0)}(\delta)=V_{(1,1\&2)(0)}(\delta)-V_{(1,1\&2)(0)}(\delta=20)$$

$\Delta V_{(1,3)(0)}(\delta, M)$:

$$\Delta V_{(1,3)(0)}(\delta, M)=V_{(1,1\ \&\ 3)(0)}(\delta)-V_{(1,1\&2)(0)}(\delta=20)$$

$\Delta V_{(1,4)(0)}(\delta, M)$:

$$\Delta V_{(1,4)(0)}(\delta,M,M')=V_{(1,1\ \&\ 2)(0)}(\{1+M+M'\}\delta)-V_{(1,1\&2)(0)}(\delta=20)\ \Delta V_{(1,\ 2)(0)}(\{1+M+M'\}\delta)$$

$\Delta V_{(2,1)(0)}(\delta)$:

$$\Delta V_{(2,1)(0)}(\delta)=V_{(1,1\&2)(0)}(-\delta)-V_{(1,1\&2)(0)}(\delta=20)=\Delta V_{(1,\ 2)(0)}(-\delta)$$

$\Delta V_{(2,3)(0)}(\delta)$:

$$\Delta V_{(2,3)(0)}(\delta)=V_{(1,1\&2)(0)}(M\delta)-V_{(1,1\&2)(0)}(\delta=20)=\Delta V_{(1,\ 2)(0)}(M\delta)$$

$\Delta V_{(2,4)(0)}(\delta)$:

$$\Delta V_{(2,4)(0)}(\delta)=V_{(1,1\&3)(0)}(\{M+M'\}\delta)-V_{(1,1\&2)(0)}(\delta=20)=\Delta V_{(1,3)(0)}(\{M+M'\}\delta)$$

$\Delta V_{(3,1)(0)}(\delta)$:

$$\Delta V_{(3,1)(0)}(\delta)=V_{(1,1\&3)(0)}(-\{1+M\}\delta)-V_{(1,1\&2)(0)}(\delta=20)=\Delta V_{(1,3)(0)}(-\{1+M\}\delta)$$

$\Delta V_{(3,2)(0)}(\delta)$:

$$\Delta V_{(3,2)(0)}(\delta)=V_{(1,1\&2)(0)}(-M\delta)-V_{(1,1\&2)(0)}(\delta=20)=\Delta V_{(1,\ 2)(0)}(-M\delta)$$

$\Delta V_{(3,4)(0)}(\delta)$:

$$\Delta V_{(3,4)(0)}(\delta)=V_{(1,1\&2)(0)}(M'\delta)-V_{(1,1\&2)(0)}(\delta=20)=\Delta V_{(1,\ 2)(0)}(M'\delta)$$

$\Delta V_{(4,1)(0)}(\delta)$:

$$\Delta V_{(4,1)(0)}(\delta)=V_{(1,1\&2)(0)}(-\{1+M+M'\}\delta)-V_{(1,1\&2)(0)}(\delta=20)=\Delta V_{(1,2)(0)}(-\{1+M+M'\}\delta)$$

$\Delta V_{(4,2)(0)}(\delta)$:

$$\Delta V_{(4,2)(0)}(\delta)=V_{(1,1\&3)(0)}(-\{M+M'\}\delta)-V_{(1,1\&2)(0)}(\delta=20)=\Delta V_{(1,\ 3)(0)}(-\{M+M'\}\delta)$$

$\Delta V_{(4,3)(0)}(\delta)$:

$$\Delta V_{(4,3)(0)}(\delta)=V_{(1,1\&2)(0)}(-M'\delta)-V_{(1,1\&2)(0)}(\delta=20)=\Delta V_{(1,2)(0)}(-M'\delta)$$

Again, when substituting these expressions into the equations for $\Delta V_{(1,1\&2\&3\&4)(f)}(\delta,M,M')$ etc., it is important to note that the function of M and M' multiplying δ in the argument, only multiplies the δ part of the argument in the frequency series (see example given for 3-phase case discussed above).

Calculation of ΔXs and $F(\delta_1, M_1, M'_1, f)$

Using the above equations for $\Delta V_{(1,\&2\&3\&4)(f)}$, $\Delta V_{(2,1\&2\&3\&4)(f)}$, $\Delta V_{(3,1\&2\&3\&4)(f)}$, and $\Delta V_{(4,1\&2\&3\&4)(f)}$, the ΔXs can be computed using:

$$\Delta X=ABS[(g.V_s.\Delta V)/\{V.(V+\Delta V)\}],\ \text{to obtain:}$$

$\Delta X_1$ for $\Delta V_{(1,1\&2\&3)(f)}(\delta_1, M_1, M_1')$
$\Delta X_2$ for $\Delta V(_{2,1\&2\&3)(f)}(\delta_1, M_1, M_1')$
$\Delta X_3$ for $\Delta V_{(3,1\&2\&3)(f)}(\delta_1, M_1, M_1')$
$\Delta X_4$ for $\Delta V_{(4,1\&2\&3)(f)}(\delta_1, M_1, M_1')$ Now F can be computed:

$$F(\delta_1, M_1, M_1', f)=(w_1.\Delta X_1+w_2.\Delta X_2+w_3.\Delta X_3+w_4.\Delta X_4)/4$$

If $\Delta X=/<e$, $w=1$

If $\Delta X>e$, $w=k$

This is a 5 dimensional function and the best way of determining the optimum regions of low F will be considered after looking at real data for the 2 and 3 phase firing methods.

N Phase (High Frequency)—Unequal Delays (Outline of Calculation)

The phases may be arranged 1,2,3 . . . N,1,2,3 . . . N The delay between phase 1 (first to fire) and phase 2 is 61, between phase 2 and 3 is 62, and between phase (N−1) and phase N is $\delta_{(N-1)}$. The delays are all expressed in terms of $\delta_1$, using parameters M, M', M" etc.

Thus, $\delta_2=M\delta_1$ $\delta_3=M'\delta_1$ $\delta_4=M''\delta_1$ etc.

The following experimental data is needed:

For N phase firing, it is sufficient to have just one set of frequency data. For this calculation outline, it is assumed to be $\Delta V_{(1,1)(f)}$. The number of sets of low frequency data required increases by 1 when N increases from an odd to an even number. Thus for 4 and 5 phase firing, 2 sets of data, $V_{(1,1\ \&\ 2)(0)}(\delta)$ and $V_{(1,1\ \&\ 3)(0)}(\delta)$, are required. But for 6 phase firing, 3 sets, $V_{(1,1\ \&\ 2)(0)}(\delta)$, $V_{(1,1\ \&\ 3)(0)}(\delta)$ and $V_{(1,1\ \&\ 4)(0)}(\delta)$, are needed. In general for N phases N/2 rounded down to an integer number of low frequency data sets are required.

General Expressions for ΔVs at High Frequency

For phase p, the ΔV with all channels firing is of the form:

$$\Delta V_{(p,1\&2\&\ \ldots\ \&N)(f)}(\delta,M,M',M''\ \ldots)=\Delta V_{(1,1)(f)}+S_1+S_2\ \ldots\ +S_r\ \ldots\ +S_{(N-1)}$$

Where each S is a frequency series $$S_1=\Delta V_{(p,1)(0)}(\delta)+[\Delta V_{(p,1)(0)}((\delta)-1/f)+\Delta V_{(p,1)(0)}((\delta)+1/f)]+\ \ldots\ [\Delta V_{(p,1)(0)}((\delta)-(n-1)/f)+\Delta V_{(p,1)(0)}((\delta)+(n-1)/f)]$$

and:

$$S_r=\Delta V_{(p,r)(0)}(\delta)+[\Delta V_{(p,r)(0)}((\delta)-1/f)+V_{(p,r)(0)}((\delta)+1/f)]+\ \ldots\ [\Delta V_{(p,r)(0)}((\delta)-(n-1)/f)+\Delta V_{(p,r)(0)}((\delta)+(n-1)/f)]$$

The other frequency series are obtained from all integer values of r between 1 and (N−1) except for r=p.

As was the case for 2-, 3- and 4-phase firing, the low frequency terms, $\Delta V_{(p,r)(0)}$, needed for the series, $S_r$, above must be expressed in terms of the experimental data. From the low frequency experimental data, the following are determined:

$\Delta V_{(1,2)(0)}(\delta)$—adjacent channels $\Delta V_{(1,3)(0)}(\delta)$—adjacent+1 channels $\Delta V_{(1,4)(0)}(\delta)$—adjacent+2 channels etc.

To express any $\Delta V_{(p,r)(0)}$ in terms of the experimental data:

$$\text{If } r>p\text{: } \Delta V_{(p,r)(0)}(\delta)=\Delta V_{(1,a)(0)}(\delta')$$

Where (a−1)=(r−p) i.e. the channels are separated by the same amount as the experimental channels (note that the closest separation can be used—e.g. phase 1 and phase N are adjacent). The argument δ' is just the delay between phases p and r.

$$\text{If } r<p\text{: } \Delta V_{(p,r)(0)}(\delta)=\Delta V_{(1,a)(0)}(-\delta')$$

While the description above refers to particular embodiments of the present invention, it will be understood that many modifications may be made without departing from the spirit thereof The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An inkjet printing system, comprising:

an array of transducers to eject ink, the array including even transducers and odd transducers; and a controller to control a firing sequence of the array of transducers, wherein an even set of the even transducers is fired, and after a delay, an odd set of the odd transducers is fired, the delay being selected based on known crosstalk and frequency response characteristics of the array of transducers to minimize crosstalk between the even set and the odd set.

2. The inkjet printing system of claim 1, wherein the inkjet printing system is a piezo-electric printing system.

3. The inkjet printing system of claim 1, wherein the delay is further selected to maximize operation of the inkjet printing system.

4. The inkjet printing system of claim 1, wherein the delay is further selected to minimize positive crosstalk.

5. The inkjet printing system of claim 1, further including a memory device to store a calculation of the delay.

6. An inkjet printing system, comprising:

an array of transducers to eject ink, the array including transducers in the set $$\sum_{i=1}^{i=n} A(i)$$

where i and n are integers, a controller to control a firing sequence of the array of transducers, wherein a first set of the transducers is fired, and after a delay, a second set of the transducers is fired, the delay being selected based on known frequency response characteristics of the array of transducers to minimize negative crosstalk between the first set and the second set.

7. The inkjet printing system of claim 6, wherein the first set of transducers includes transducers in a set $$\sum_{i=1}^{i=m} A(X*i),$$

where m is an integer and (X*m) is not greater than n, and the second set of transducers includes transducers in a set $$\sum_{i=1}^{i=p} A(X*i+1),$$

where (X*p+1) is not greater than n.

8. The inkjet printing system of claim 6, further including a third set of transducers to fire after a second delay after the second set is fired, wherein the third set of transducers includes transducers in a set $$\sum_{i=1}^{i=q} A(X*i+2),$$

where q is an integer and (X*q+2) is not greater than n, and the second delay is selected to minimize negative crosstalk between the first set, the second set, and the third set.

9. The inkjet printing system of claim 8, further including a fourth set of transducers to fire after a third delay after the third set is fired, wherein the third set of transducers includes transducers in the set $$\sum_{i=1}^{i=r} A(X*i+3),$$

where r is an integer and (X*r+3) is not greater than n, and the third delay is selected to minimize negative crosstalk between the first set, the second set, the third set, and the fourth set.

10. The inkjet printing system of claim 6, wherein the inkjet printing system is a piezo-electric printing system.

11. The inkjet printing system of claim 6, wherein the delay is further selected to maximize operation of the inkjet printing system.

12. The inkjet printing system of claim 6, wherein the delay is further selected to minimize positive crosstalk.

13. The inkjet printing system of claim 6, further including a memory device to store a measurement of the delay.

14. A method of determining delays in an inkjet printing system, comprising:

measuring an amount of crosstalk received by a first set of transducers, within a predetermined time range, relative to a time at which a second set of transducers is fired; and selecting a delay to minimize the amount of the crosstalk and allow each of the first set and the second set of the transducers to operate at a predetermined maximum firing frequency.

15. The method of claim 14, further including measuring a second amount of crosstalk received by the first set of the transducers, within the predetermine time range, relative to a second time at which a third set of transducers is fired.

16. The method of claim 15, wherein the selecting of the delay is further utilized to minimize the second amount of the crosstalk and allow each of the first set, the second set, and the third set of the transducers to operate at the predetermined maximum firing frequency.

17. An article comprising a storage medium having stored thereon instructions that when executed by a machine result in the following:

measuring an amount of crosstalk received by a first set of transducers, within a predetermined time range, relative to a time at which a second set of transducers is fired; and selecting a delay to minimize the amount of the crosstalk and allow each of the first set and the second set of the transducers to operate at a predetermined maximum firing frequency.

18. The article of claim 17, further including measuring a second amount of crosstalk received by the first set of the transducers, within the predetermine time range, relative to a second time at which a third set of transducers is fired.

19. The article of claim 18, wherein the selecting of the delay is further utilized to minimize the second amount of the crosstalk and allow each of the first set, the second set, and the third set of the transducers to operate at the predetermined maximum firing frequency.

20. A method of determining a delay for a channel of an inkjet printer, comprising:

determining a set of channels to be fired within a predetermined time period;

acquiring predetermined crosstalk data for each of the channels to be fired; and selecting a set of delay values to minimize crosstalk between the set of the channels.

21. The method of claim 20, wherein the predetermined crosstalk data is stored in a memory.

22. The method of claim 20, wherein the predetermined crosstalk data includes separate crosstalk data for each channel in the set being fired relative to each other channel in the set being individually fired.

23. The method of claim 20, wherein the set of channels includes individual channels, and a delay for each channel in the set is determined individually.

24. The method of claim 20, wherein the set of channels includes groups of channels, and a group delay for each of the groups is determined.

25. The method of claim 20, wherein the delay values are selected in real-time.

26. An article comprising a storage medium having stored thereon instructions that when executed by a machine result in the following:

determining a set of channels to be fired within a predetermined time period;

acquiring predetermined crosstalk data for each of the channels to be fired; and selecting a set of delay values to minimize crosstalk between the set of the channels.

27. The article of claim 26, wherein the predetermined crosstalk data is stored in a memory.

28. The article of claim 26, wherein the predetermined crosstalk data includes separate crosstalk data for each channel in the set being fired relative to each other channel in the set being individually fired.

29. The article of claim 26, wherein the set of channels includes individual channels, and a delay for each channel in the set is determined individually.

30. The article of claim 26, wherein the set of channels includes groups of channels, and a group delay for each of the groups is determined.

31. The article of claim 26, the instructions further resulting in the delay values being selected in real-time.

32. An inkjet printing system, comprising:

an array of transducers;

a memory device to store crosstalk data for each of the transducers in the array;

a processor to determine and select, in real time, a set of delay values to minimize crosstalk between a set of the transducers to be fired within a predetermined time period; and a controller to fire the set of the transducers and implement the set of delay values.

33. The system of claim 32, wherein the predetermined crosstalk data includes separate crosstalk data for each transducer in the set being fired relative to each other transducer in the set being individually fired.

34. The system of claim 32, wherein the set of transducers includes individual transducers, and a delay for each transducer in the set is determined individually.

35. The system of claim 32, wherein the set of transducers includes groups of transducers, and a group delay for each of the groups is determined.

* * * * *